US011933128B2

(12) United States Patent
Gabaldon et al.

(10) Patent No.: US 11,933,128 B2
(45) Date of Patent: Mar. 19, 2024

(54) PRESSURE MANAGEMENT SUB-SYSTEMS FOR SUBSEA MANAGED PRESSURE OPERATIONS

(71) Applicant: BLADE ENERGY PARTNERS, LTD., Frisco, TX (US)

(72) Inventors: Oscar R. Gabaldon, Frisco, TX (US); Patrick R. Brand, Anna, TX (US)

(73) Assignee: BLADE ENERGY PARTNERS LTD., Frisco, TX (US)

( * ) Notice: Subject to any disclaimer, the term of this patent is extended or adjusted under 35 U.S.C. 154(b) by 0 days.

(21) Appl. No.: 18/148,485

(22) Filed: Dec. 30, 2022

(65) Prior Publication Data

US 2023/0135617 A1 May 4, 2023

Related U.S. Application Data

(63) Continuation of application No. 17/347,248, filed on Jun. 14, 2021, now Pat. No. 11,542,772, which is a continuation of application No. 16/687,954, filed on Nov. 19, 2019, now Pat. No. 11,035,192.

(60) Provisional application No. 62/776,884, filed on Dec. 7, 2018.

(51) Int. Cl.

| | |
|---|---|
| ***E21B 33/035*** | (2006.01) |
| ***E21B 17/01*** | (2006.01) |
| ***E21B 33/064*** | (2006.01) |
| ***E21B 34/04*** | (2006.01) |

(52) U.S. Cl.

CPC ..... *E21B 33/0355* (2013.01); *E21B 17/01* (2013.01); *E21B 33/064* (2013.01); *E21B 34/04* (2013.01)

(58) Field of Classification Search

CPC .... E21B 33/0355; E21B 17/01; E21B 33/064; E21B 34/04; E21B 21/085; E21B 21/082

See application file for complete search history.

(56) References Cited

U.S. PATENT DOCUMENTS

| | | | |
|---|---|---|---|
| 9,187,973 | B2 | 11/2015 | Cain et al. |
| 9,574,426 | B2 | 2/2017 | Cain et al. |
| 11,035,192 | B1 | 6/2021 | Gabaldon et al. |
| 11,428,069 | B2 | 8/2022 | Affleck et al. |
| 11,542,772 | B2 | 1/2023 | Gabaldon et al. |

(Continued)

FOREIGN PATENT DOCUMENTS

WO 2017/0115344 A2 7/2017

OTHER PUBLICATIONS

United States Patent & Trademark Office, Office Action dated Oct. 8, 2020 in co-pending U.S. Appl. No. 16/687,954, now U.S. Pat. No. 11,035,192.

(Continued)

*Primary Examiner* — James G Sayre

(74) *Attorney, Agent, or Firm* — Jeffrey L. Wendt; THE WENDT FIRM, P.C.

(57) ABSTRACT

Systems and processes for subsea marine managed pressure operations. One system includes a modified riser joint configured to fluidly connect inline with one or more riser joints. The modified riser joint and the one or more riser joints are connected to form a riser connecting a floating vessel with a wellhead. The system further includes a subsea pressure management sub-system configured to be operatively and fluidly connected to the modified riser joint at a subsea location.

10 Claims, 8 Drawing Sheets

(56) References Cited

U.S. PATENT DOCUMENTS

| | | | | |
|---|---|---|---|---|
| 2003/0066650 | A1* | 4/2003 | Fontana | E21B 21/085 166/358 |
| 2004/0060737 | A1* | 4/2004 | deBoer | E21B 21/08 175/7 |
| 2004/0238177 | A1* | 12/2004 | Fossli | E21B 21/08 166/367 |
| 2007/0193778 | A1 | 8/2007 | Wooten | |
| 2012/0267118 | A1 | 10/2012 | Orbell et al. | |
| 2013/0192841 | A1* | 8/2013 | Feasey | E21B 21/001 166/336 |
| 2013/0206423 | A1* | 8/2013 | Weinstock | E21B 7/12 166/358 |
| 2014/0151063 | A1 | 6/2014 | Wright | |
| 2014/0216751 | A1 | 8/2014 | Liezenberg | |
| 2104/0262309 | | 9/2014 | Cain et al. | |
| 2016/0024892 | A1 | 1/2016 | Cain et al. | |
| 2017/0044857 | A1* | 2/2017 | Leuchtenberg | E21B 21/10 |
| 2019/0055791 | A1 | 2/2019 | Barela | |
| 2019/0376350 | A1 | 12/2019 | Deul et al. | |
| 2021/0317722 | A1 | 10/2021 | Affleck et al. | |

OTHER PUBLICATIONS

Gabaldon et al., Response to United States Patent & Trademark Office, Office Action dated Oct. 8, 2020 in co-pending U.S. Appl. No. 16/687,954, now U.S. Pat. No. 11,035,192.

United States Patent & Trademark Office, Office Action dated Jan. 21, 2021 in co-pending U.S. Appl. No. 16/687,954, now U.S. Pat. No. 11,035,192.

Gabaldon et al., Response to United States Patent & Trademark Ofice, Office Action dated Jan. 21, 2021 in co-pending U.S. Appl. No. 16/687,954, now U.S. Pat. No. 11,035,192.

United States Patent & Trademark Office, Notice of Allowance dated Apr. 30, 2021 in co-pending U.S. Appl. No. 16/687,954, now U.S. Pat. No. 11,035,192.

Gabaldon et al., Amendment After Allowance in Response to United States Patent & Trademark Ofice, Notice of Allowance dated Apr. 30, 2021 in co-pending U.S. Appl. No. 16/687,954, now U.S. Pat. No. 11,035,192.

United States Patent & Trademark Office, Office Action dated Apr. 26, 2022 in co-pending U.S. Appl. No. 17/347,248, now U.S. Pat. No. 11,542,772.

Gabaldon et al., Response to United States Patent & Trademark Office, Office Action dated Apr. 26, 2022 in co-pending U.S. Appl. No. 17/347,248, now U.S. Pat. No. 11,542,772.

United States Patent & Trademark Office, Office Action dated Oct. 7, 2022 in co-pending U.S. Appl. No. 17/347,248, now U.S. Pat. No. 11,542,772.

Gabaldon et al., Response to United States Patent & Trademark Office, Office Action dated Oct. 7, 2022 in co-pending U.S. Appl. No. 17/347,248, now U.S. Pat. No. 11,542,772.

United States Patent & Trademark Office, Notice of Allowance dated Oct. 26, 2022 in co-pending U.S. Appl. No. 17/347,248, now U.S. Pat. No. 11,542,772.

Park, D., Brand, P.R., Allyson, B., Sodersano, G.: "Planning and Implementation of the Repsol-YPF-MAXUS Krisna Underbalanced Drilling Project", pp. 1-9, paper SPE 67689 presented at the IADC/SPE Drilling Conference, Feb. 2001, published by SPE/IADE (2001).

Smith, S. P., Gregory, G. A., Brand, P. R.: "Application of Multiphase Flow Methods to Underbalanced Drilling Pilot Test Data", pp. 223-234, BHR Group Multiphase Technology Conference 2000, Calgary, Canada, published by BHR Group (2000).

Brand P. R., Frink, P.J., et al.: "A Case Study: Drilling Underbalanced in Mobil Indonesia's Arun Field", pp. 1-12, paper presented at IADC UBD Operations Forum, Nov. 1999, published by IADE (1999).

Leuchtenberg, C., Brand P. R., Suryanarayana, P. V., Eberhard,D., Frink, P .J.: "Development and Performance of Surface Equipment for High Temperature Underbalance Drilling in a Sour, Severely Under Pressured Formation", pp. 1-10, ASME Energy Sources Technology Conference, Houston, TX, Feb. 1999. Published by ASME (1999).

Quitzau, R., Brand, P.R., Tarr, B.A., Frink, P.J. Leuchtenberg, C.: "System for Drilling an Offshore Shallow Sour Gas Carbonate Reservoir," pp. 1-9, paper SPE 52808, 1999. Published by SPE/IADE (1999).

Pickles, R., Brand, P.R., Savage, P.: "Utilization of Underbalanced Drilling Techniques to Exploit a Low-Pressure Reservoir in Indonesia", pp. 1-8, paper SPE 91591. Published by SPE/IADE (2004).

Mykytiw, C., Suryanarayana, S., Brand, P.: "Practical Use of a Multiphase Flow Simulator for Underbalanced Drilling Applications Design—The Tricks of the Trade", pp. 1-10, SPE 91598. Published by SPE (2004).

Johnson, M., Brand, Patrick Richard, French, S., Sarber, J., Hildreth, D., Harris, R., Escarra, P., Cassee, U., Clark, J.: "Colled-Tubing Underbalanced Drilling Applications in the Lisburne Field, Alaska", SPE 108337, pp. 1-11, presented at the proceedings IADC/SPE MPD & Underbalanced Operations Conference 2007, Galveston, TX. Pub. by IADE/SPE (2007).

Gabaldon, O., Culen, M., Brand, Pat: "Enhancing Well Control Through Managed Pressure Drilling", pp. 1-11, OTC 25256, presented at the proceedings Offshore Technology Conference 2014, Houston, TX. Published by Offshore Technology Conference (2014).

Culen, M., Brand, P.R., Bacon, W., Gabaldon, O.: "Evolution of the MPD Operations Matrix: The Influx Management Envelope", pp. 1-18, SPE 179191 presented at the proceedings SPE/IADC MPD and Underbalanced Operations Conference 2016, Galveston, TX. Published by SPE/IADE (2016).

Bacon, W., Sugden, C., Brand, Patrick, Gabaldon, O., Culen, M.: "MPD Dynamic Influx Control Mitigates Conventional Well Control Pitfalls", pp. 1-22, SPE 179185 presented at the proceedings SPE/IADC MPD and Underbalanced Operations Conference 2016, Galveston, TX. Published by SPE/IADE (2016).

Pinheiro da Silva, T., Hollman, L., Puerto, G., Brand, Patrick: "Bridging the gap between MPD and Well Control", pp. 1-14, SPE 178810 presented at the proceedings IADC/SPE Drilling Conference 2016, Fort Worth, TX. Published by IADE/SPE (2016).

Gabaldon, O., Brand, P., et al: "Case study: First Experience of Developing an Influx Management Envelope IME for a Deepwater MPD Operation", pp. 1-32, SPE 185289 presented at the SPE/IADC MPD and Underbalanced Operations Conference 2017, Netherlands. Published by SPE (2017).

United States Patent & Trademark Office, Office Action for 18148481, dated Jul. 13, 2023; 8 pages.

Gabaldon et al., Amendment and Response for 18148481 filed on Oct. 13, 2023; 7 pages.

Notice of Allowance and Fee Due with Notice of Allowability for 18148481 dated Oct. 25, 2023; 22 pages.

* cited by examiner

PRESSURE MANAGEMENT SUB-SYSTEMS FOR SUBSEA MANAGED PRESSURE OPERATIONS

CROSS-REFERENCE TO RELATED APPLICATIONS

This application is a continuation of and entitled to and claims the benefit of earlier filed. United. States nonprovisional application No. 17347248, filed Jun. 14, 2021, now U.S. Pat. No. 11,542,772, which was a continuation of application Ser. No. 16/687,954, filed Nov. 19, 2019, now U.S. Pat. No. 11,035,192, and which is entitled to and claims the benefit of earlier filed U.S. provisional application No. 62/776,884, filed Dec. 7, 2018, under 35 U.S.C. § 119(e), which earlier filed nonprovisional and provisional applications are incorporated by reference herein in their entirety.

BACKGROUND INFORMATION

Technical Field

The present disclosure relates to systems and processes of using same for subsea managed pressure operations in the marine subsea (offshore subsea) hydrocarbon production field. In particularly, the present disclosure relates to systems and processes useful for performing a variety of subsea managed pressure operations controlled from one or more surface vessels, where such work needs to be done safely, either while such facilities are in operation, or during facility shutdowns, adverse weather events, and the like.

Background Art

Drilling for oil and gas often encounter specific challenges, typically dictated by the downhole drilling window. Some of those challenges are mitigated or addressed by using non-conventional drilling techniques, which may include one or more variants of Managed Pressure Drilling (MPD).

The American Petroleum Institute defines MPD:

"Managed pressure drilling (MPD) is an adaptive drilling process used to precisely control the annular pressure profile throughout the wellbore. The objectives are to ascertain the downhole pressure environment limits and to manage the annular hydraulic pressure profile accordingly. It is the intention of MPD to avoid continuous influx of formation fluids. Any influx incidental to the operation shall be safely contained using an appropriate process. The following are aspects of MPD operations.

a) MPD process employs a collection of tools and techniques which can mitigate the risks and costs associated with drilling wells that have narrow downhole environmental limits, by proactively managing the annular pressure profile.
b) MPD may include control of back-pressure, fluid density, fluid rheology, annular fluid level, circulating friction, and hole geometry, or combinations thereof.
c) When compared to conventional overbalanced drilling, MPD can allow faster corrective action to deal with observed pressure variations. The ability to dynamically control annular pressures facilitates drilling of what might otherwise be technically unattainable prospects."

Managed Pressure Drilling Operations—Surface Back-pressure with a Subsea Blowout Preventer. API RECOMMENDED PRACTICE 92S. FIRST EDITION, SEPTEMBER 2018.

To enable implementation of MPD, the drilling unit must be fitted with specific equipment, which typically enables more precise control of hydraulic pressure profiles along the wellbore. This pressure profile control may be achieved by manipulation of: 1) annular surface back pressure, 2) annular friction, 3) drilling fluid density, and 4) combination and/or height of annular fluids in the wellbore, or a combination of two or more of these parameters.

MPD variants can include applied surface backpressure MPD (SBP MPD), floating mud cap drilling (FMCD), dynamic mud cap drilling (DMCD), pressurized mud cap drilling (PMCD), Dual Gradient Drilling (DGD), underbalanced drilling (UBD), and others. All these are more or less industry wide practices to drill oil and gas wells, where conventional drilling practices prove challenging because of a wide range of situations.

When drilling from floating drilling rigs, the implementation of MPD requires significant lead times to plan, design and install the required equipment on the drilling unit. This lead time may be between 6 to 12 months, depending on the complexity of the system design and availability of the components. Additionally, available space on the drilling unit is normally limited, adding to the challenges to locate the equipment, and physically implement the required interconnection between the MPD equipment and the rig's equipment. Once installed, the MPD equipment must be inspected, and often certified by the classification society (e.g., DNV, ABS, Lloyd's Register, etc.) that provides class certification for the drilling unit.

Various efforts in this area may be exemplified by U.S. Pat. Nos. 9,074,446; 9,874,060; 10,099,752; and U.S. Published patent application nos. 20140190701A1; and WO/2017/115344A2. However, none of these documents mention use of a modified riser joint, nor is there mention of a pressure management sub-system operatively connected to a modified riser joint, as taught by the present disclosure.

As may be seen, current practice may not be adequate for all circumstances, and at worst may result in injury to workers. There remains a need for more safe, robust subsea managed pressure systems and processes. The systems and processes of the present disclosure are directed to these needs.

SUMMARY

In accordance with the present disclosure, systems and processes are described which reduce or overcome many of the faults of previously known systems and processes.

A first aspect of the disclosure is a system comprising:

(a) a modified riser joint configured to fluidly connect inline with one or more riser joints, the modified riser joint and the one or more riser joints configured to be connected to form a riser connecting a floating vessel with a wellhead; and (b) a subsea pressure management sub-system configured to be operatively and fluidly connected to the modified riser joint at a subsea location.

In certain embodiments the subsea pressure management sub-system may be one or more self-contained modules connected to the floating vessel with one or more control umbilicals. In certain embodiments the modified riser joint may comprise a sealing device and an annular blow out preventer (BOP). In certain embodiments the sealing device may be selected from the group consisting of a rotating flow control device (RCD) and a non-rotating flow control device (NRCD). In certain embodiments the floating vessel may be selected from the group consisting of a drillship, a drilling rig, a mobile offshore drilling unit (MODU), and combinations thereof. In certain embodiments the subsea modified riser joint may be dependent upon a control umbilical connected to the MODU. In certain embodiments the sub sea pressure management sub-system may comprise one or more components selected from the group consisting of one or more pressure control devices, (also referred to as chokes), one or more mud pumping devices, one or more flow measurement devices, one or more accessory equipment, and combinations thereof. In certain embodiments the one or more accessory equipment may be selected from the group consisting of one or more connectors, one or more isolation valves, and one or more pressure relief valves. In certain embodiments the one or more components may comprise one or more redundant components in the subsea pressure management sub-system. Certain system embodiments may comprise one or more quick connect/quick disconnect connectors.

A second aspect of the disclosure is a process comprising:

(a) operatively and fluidly connecting the floating vessel with the wellhead employing the riser of the system of the first aspect;

(b) operatively and fluidly connecting the subsea pressure management sub-system with the modified riser joint of the system of the first aspect at the subsea location; and (c) performing a "managed pressure operation" (defined as any managed pressure well drilling or well maintenance technology where continuous back-pressure is applied where and when applicable) employing the floating vessel, the riser, and the subsea pressure management sub-system.

The term "MODU" is to be interpreted to include, but is not limited to, floating platforms, floating drill ships, semi-submersibles, tension leg platforms (TLPs), spars, and floating production, storage, and offloading vessels (FPSOs). As used herein the term "subsea" includes oceans, bays, rivers, bayous, gulfs, and includes deepwater and non-deepwater. As used herein, "modified" when used in conjunction with "riser joint" means the riser joint includes one or more internal components sufficient to a) shutdown flow through a production pipe or tubing positioned therein, and b) seal the annulus between the riser joint and the piping or tubing. As used herein "riser joint" when not modified by the word "modified" means a standard riser joint, either a low-pressure riser joint or a high-pressure riser joint.

In certain embodiments a logic device may be provided to control the subsea pressure management sub-system, and the logic device may be configured to be operated and/or viewed from a Human/Machine Interface (HMI) wired or wirelessly connected to the logic device. Certain embodiments may include one or more audio and/or visual warning devices configured to receive communications from the logic device upon the occurrence of a pressure rise (or fall) in a sensed pressure above (or below) a set point pressure, or a change in concentration of one or more sensed concentrations or temperatures, or both, above one or more set points. The occurrence of a change in other measured parameters outside the intended ranges may also be alarmed in certain embodiments. Other measured parameters may include, but are not limited to, liquid or gas flow rate, and liquid density.

Certain system and process embodiments of this disclosure may comprise shutting down one, more than one, or all operational equipment inside and/or outside the modified riser joint using the pressure management sub-system (for example as dictated by a client, law, or regulation), in certain embodiments at least operational equipment inside the modified riser joint, upon the occurrence of the adverse event. As used herein, the term "operational equipment" means equipment defined by the operator or owner of the facility being worked and/or utilized as part of the job as being required to be shut down on the occurrence of an adverse event. "Adverse event" means the presence of well fluids at high-pressure inside the production conduit (piping or tubing) inside the modified riser joint, and which the pressure management sub-system is designed to shutoff above a maximum set point pressure (which may be independently set for each modified riser joint, if more than one is employed). In certain embodiments this may correspond with the detection of pressure by the pressure management sub-system above a maximum set point pressure. "Non-adverse event" or time periods are interchangeable with "safe operating conditions" and "safe working conditions."

Certain system and process embodiments of this disclosure may operate in modes selected from the group consisting of automatic continuous mode, automatic periodic mode, and manual mode. In certain embodiments the one or more operational equipment may be selected from the group consisting of pneumatic, electric, fuel, hydraulic, and combinations thereof.

In certain embodiments, pressure (P) may be sensed inside the modified riser joint, while temperature (T) is sensed inside the pressure management sub-system(s). Different pressure management sub-systems within a set of pressure management sub-systems may have different sensor strategies, for example, a mass flow sensor for one pressure management sub-system sensing mass flow inside the pressure management sub-system, another sensing mass flow inside a second pressure management sub-system. All combinations of sensing T, P, and/or mass flow inside and/or outside one or more pressure management sub-systems are disclosed herein and considered within the present disclosure.

As used herein "pressure management sub-system" means a structure including a cabinet, frame, or other structural element supporting (and in some embodiments enclosing) pressure management components and associated components, for example, but not limited to pressure control devices (backpressure valves), pressure relief devices (valves or explosion discs), pipes, conduits, vessels, towers, tanks, mass flow meters, temperature and pressure indicators, heat exchangers, pumps, compressors, and quick connect/quick disconnect (QC/QD) features for connecting and disconnecting choke umbilicals, kill umbilicals, and the like. With respect to "pressure management" and "managed pressure", when referring to a pressure management sub-system, these terms have generally understood meaning in the art (see for example the patent documents and technical articles cited herein, such as US20140190701A1) and the terms connote sufficient structure to persons of ordinary skill in the art. The managed pressure may, in some embodiments, be from about 500 psi to about 10,000 psi or greater; alternatively greater than about 700 psi; alternatively greater than about 800 psi; alternatively greater than about 1,000, or greater than about 2,000 psi, or greater than about 3,000 psi. For example, managed pressures may range from about 2,000 to about 5,000 psi; or from about 2,500 to about 4,500 psi; or from about 3,000 to about 4,000; or from about 2,500 to about 5,000 psi; or from about 2,000 to about 4,500 psi; or from about 2,000 to about 3,000 psi; or from about 4,000 to about 5,000 psi; or from about 3,000 to about 10,000 psi; or from about 4,000 to about 8,000 psi; or from about 5,000 to about 10,000 psi. All ranges and sub-ranges (including endpoints) between about 500 psi and about 10,000 psi are considered explicitly disclosed herein.

These and other features of the systems and processes of the present disclosure will become more apparent upon review of the brief description of the drawings, the detailed description, and the claims that follow. It should be understood that wherever the term "comprising" is used herein, other embodiments where the term "comprising" is substituted with "consisting essentially of" are explicitly disclosed herein. It should be further understood that wherever the term "comprising" is used herein, other embodiments where the term "comprising" is substituted with "consisting of" are explicitly disclosed herein. Moreover, the use of negative limitations is specifically contemplated; for example, certain sensors may trigger audible alarms but not visual alarms, and vice versa. As another example, a pressure management sub-system may be devoid of a rotating control device.

BRIEF DESCRIPTION OF THE DRAWINGS

The manner in which the objectives of this disclosure and other desirable characteristics can be obtained is explained in the following description and attached drawings in which:

It is to be noted, however, that the appended drawings of FIGS. 1-6 are not to scale, and illustrate only typical system embodiments of this disclosure. Furthermore, FIGS. 7-9 illustrate only three of many possible processes of this disclosure. Therefore, the drawing figures are not to be considered limiting in scope, for the disclosure may admit to other equally effective embodiments. Identical reference numerals are used throughout the several views for like or similar elements.

DETAILED DESCRIPTION

Figure 1:
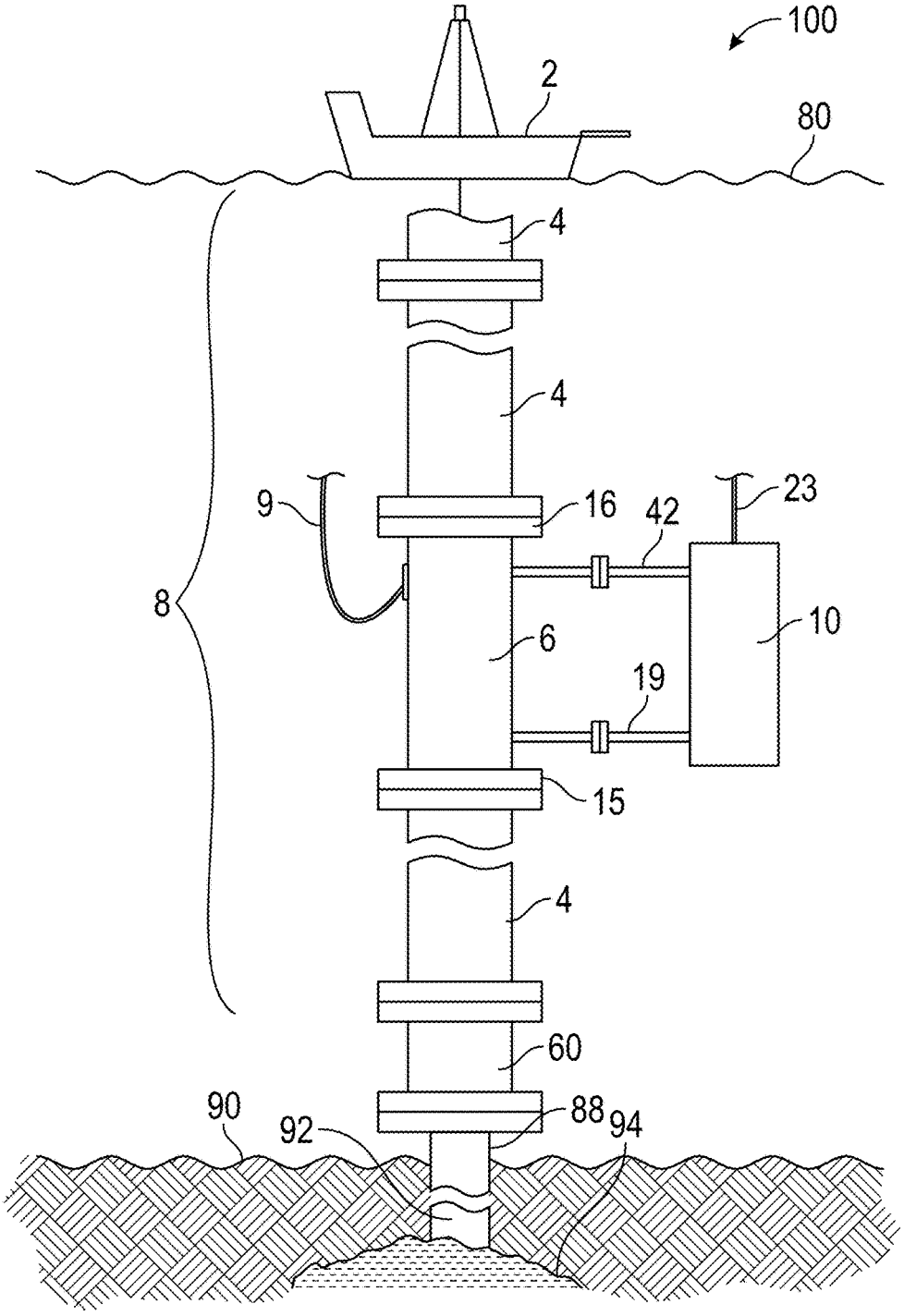
FIG. 1 is a schematic side elevation view illustrating one system in accordance with the present disclosure.

In the following description, numerous details are set forth to provide an understanding of the disclosed apparatus, combinations, and processes. However, it will be understood by those skilled in the art that the apparatus, systems, and processes disclosed herein may be practiced without these details and that numerous variations or modifications from the described embodiments may be possible. All technical articles, U.S. published and non-published patent applications, standards, U.S. patents, U.S. statutes and regulations referenced herein are hereby explicitly incorporated herein by reference, irrespective of the page, paragraph, or section in which they are referenced. Where a range of values describes a parameter, all sub-ranges, point values and endpoints within that range or defining a range are explicitly disclosed herein. All percentages herein are by weight unless otherwise noted.

As mentioned herein, when drilling from floating drilling rigs, the implementation of MPD requires significant lead times to plan, design and install the required equipment on the drilling unit. This lead time may be between 6 to 12 months, depending on the complexity of the system design and availability of the components. Additionally, available space on the drilling unit is normally limited, adding to the challenges to locate the equipment, and physically implement the required interconnection between the MPD equipment and the rig's equipment. Once installed, the MPD equipment must be inspected, and often certified by the classification society (e.g., DNV, ABS, Lloyd's Register, etc.) that provides class certification for the drilling unit. As may be seen, current practice may not be adequate for all circumstances, and at worst may result in injury to workers. There remains a need for more safe, robust subsea managed pressure systems and processes. The systems and processes of the present disclosure are directed to these needs.

With respect specifically to MPD, systems and processes of the present disclosure enable virtually any floating drilling unit to perform MPD operations, with minimal to no modifications to the drilling unit equipment. Specifically, there are no required modifications to the drilling mud circulating and processing system on the drilling unit. Systems and process of the present disclosure also provide benefits compared to the majority of the existing MPD systems currently available in the industry. The specific configuration of certain embodiments of systems and processes of the present disclosure defines the possible variants of MPD operations capabilities of the system. These variants include, but are not limited to, applied surface backpressure MPD (SBP MPD); floating, dynamic and pressurized mud cap drilling (FMCD, DMCD and PMCD); and Dual Gradient Drilling (DGD).

As described in more detail herein with reference to the various drawing figures, systems and processes of the present disclosure are comprised of two main components, the first being a modified riser joint (MRJ), which will be installed as part of the marine riser for drilling the subsea well. The location of the MRJ relative to the drilling rig/floating vessel is determined based on the desired application for the system. Factors such as umbilical control lines, water depth, hole sections and sizes to be drilling with MPD system, and desired pressure control mode, among others, can impact the placement of the MRJ.

The second main component of systems and processes of the present disclosure is a subsea pressure management sub-system (PMSS), in certain embodiments described as a Managed Pressure Drilling module (MPDM), which may comprise a combination of: one or more pressure control devices, also referred to as chokes; one or more mud pumping devices; one or more flow measurement devices (also referred to herein as mass flow meters or mass flow sensors); and in certain embodiments one or more accessory equipment such as one or more connectors, one or more isolation valves, one or more pressure relief devices, among others. The specific configuration of the PMSS or MPDM defines the type of managed pressure operation capabilities of each system and process embodiment. Redundancy of components in the PMSS/MPDM allows for extended service periods and mitigates risk of downtime due to component failure. An example would be a pressure control device (choke) plugging with drilled cuttings, or washout due to erosion. In this case, isolating the failed component and enabling another one allows for continued operations, and enables evaluation and/or modification of the operational parameters to minimize the risk of failure of the new component in use.

Furthermore, certain systems and processes of the present disclosure may be designed to be installed in such a way that the PMSS/MPDM may be retrieved from subsea to the surface, by using remotely operated vehicle (ROV) friendly quick connectors (or other means) between the PMSS/MPDM and the MRJ. These embodiments allow servicing the PMSS/MPDM components subject to potential failure during operations or in between hole sections, without the need to pull the riser to service components. These embodiments are particularly practical for servicing pressure control devices (or chokes), which may be subject to plugging or washouts.

Advantageously, most of the components of systems and processes of the present disclosure may be sourced from existing pieces of equipment used in the oil and gas drilling industry, for conventional drilling, MPD or other operations. Some of the components of the systems of the present disclosure may be based on existing equipment, which require modifications for remote/subsea operation. The innovative nature of systems and processes of the present disclosure relies on the concept of combining all the managed pressure equipment on the subsea components, eliminating the surface equipment and challenges associated with design, fabrication, installation, interconnection, operation and servicing of surface equipment (equipment located on or in surface vessels). The installation of systems and processes of the present disclosure on the drilling unit requires minimal interfacing. There is no intervention needed to integrate the system with the mud system. All required interfaces are consolidated in the MRJ. The mud flow path on the surface/floating vessel, as well as the well control system, remains untouched. With respect to the riser, the MRJ is connected to the marine riser system, but no modifications to the riser are required. The MRJ connections need to be made compatible with the specific riser connections existing on the drilling unit. This may be achieved by fabricating crossovers for bottom and top connections. Alternatively, for systems of this disclosure permanently assigned to a drilling unit, the riser connections may be integrated on the bottom and top of the MRJ, eliminating the need to fabricate costly crossovers.

Systems and processes of the present disclosure may be operated using hydraulic and/or electric power. One possible configuration is full electric power to operate the PMSS/MPDM, and hydraulic power to operate the MRJ. In certain embodiments, both electric and hydraulic power supply may have redundant and/or back up power supply. In certain embodiments, hydraulic power may require installation of an additional hydraulic unit on the drilling rig, possibly including storage for pressurized fluid for backup power. In certain embodiments, the drilling unit's electric generators may provide electric power, and backup power may be provided by an uninterruptible power supply (UPS) battery system.

In certain embodiments, the MRJ may be stored on the drilling unit/floating vessel on the riser deck, on a dedicated crate fabricated for this purpose. In certain embodiments, running the MRJ may be done with the conventional riser handling equipment, provided the final size and weight are within the handling capability. In certain embodiments the MRJ may be fabricated with a maximum outside diameter (OD) such that it can be made on the riser on the rotary table, then lowered to the moon pool as a regular (non-modified) marine riser joint. In certain embodiments, the PMSS/MPDM may be located on existing facilities on the drilling unit/floating vessel, such as the Christmas tree trolley (or BOP trolley), and prepared to be run from there. In these embodiments, once the MRJ is at the moon pool position, below the rotary table, the Christmas tree trolley (or BOP trolley) may be used to bring the PMSS/MPDM close to the MRJ and the quick connections made. In certain embodiments, umbilical lines for MRJ and PMSS/MPDM may be connected during this period. Since there are no hoses connecting flow paths between the systems of the present disclosure and the drilling unit/floating vessel, significant time is saved in comparison to running the current (non-modified) MPD riser joints, which typically require two or three large, heavy hoses to be connected when the joint is at the moon pool.

As explained herein, in certain embodiments reels may be employed to store and handle umbilical lines. One embodiment may comprise: 1) a reel with hydraulic lines for operating all valves and components on the MRJ, and low power electric connections for data transmission for sensors (e.g., pressure, temperature, position indicators, among others); and 2) a reel with electric cable to provide power for operating valves and components on the PMSS/MPDM, as well as low power electric connections for data transmission for sensors (e.g., pressure, temperature, position indicators, flow rates, fluid density, among others). In these embodiments, the reel for the PMSS/MPDM umbilical may also be designed to provide mechanical support for holding some or all the weight of the PMSS/MPDM while being run, and/or during managed pressure operations, and/or when retrieved. These reels may be installed next to the moon pool if space is available.

With respect to data connection/integration, in certain embodiments control signals for the components of the subsea system of the present disclosure, as well as parameters measured or captured by the system's sensors (e.g., pressures, temperatures, fluid flow rates and density, position indicators, etc.) may be transmitted to and from the drilling unit/floating vessel from and to the subsea PMSS/MPDM and MU. In certain embodiments, the umbilical control lines may provide the means for this data transmission. On the drilling unit/floating vessel, the data may be integrated at different levels, potentially with different control systems. This integration may be similar to data connection and integration with rig's systems currently implemented on various MPD systems. Examples of control systems which can potentially integrate data to and from the systems of the present disclosure include control systems for MPD (installed ad hoc for MPD operations), mud logging, drawworks, top drive, rotary table, pipe handling, and the like. In certain embodiments, data integration may require running cables between different locations on the drilling unit/floating vessel. Industry standards, operator requirements, and/or local laws may dictate cable routing configurations.

With respect to installing systems of the present disclosure, compared to current MPD systems, there are no heavy hoses to connect to the MRJ. Also, once below the rotary table, umbilical line needs to be connected to the MRJ, in similar fashion to the current MPD systems requirement. Additional time may be required to connect the PMSS/MPDM to the MRJ, which may be done at the moon pool level. Alternatively, if the PMSS/MPDM is to be connected to a MRJ already positioned subsea, ROVs or autonomous underwater vehicles (AUVs) may be employed to guide the PMSS/MPDM to its intended location, typically near the seabed or any other location along the riser. Suitable PMSS/MPDMs and MRJs are now explained in more detail.

Referring now to the drawing figures, FIG. 1 is a schematic side elevation view, highly simplified, of one installed system embodiment 100 in accordance with the present disclosure, including a floating vessel 2 on an ocean surface 80, one or more riser joints 4 above and below a modified riser joint (MRJ) 6 fluidly and mechanically connected to form a riser 8, a pressure management sub-system (PMS S) 10 fluidly and mechanically connected to MRJ 6 through flow conduits 19 and 42, and a non-modified riser joint 4 fluidly and mechanically connected to a BOP 60 and wellhead 88 at the seabed 90, open hole or casing 92, and ultimately to a subsea reservoir 94. It will be understood that aspects of the present disclosure include the MRJ alone, the PMSS/MPDM alone, systems including the MRJ and PMSS/MPDM, and systems including all of the components illustrated in FIG. 1.

Figure 2:
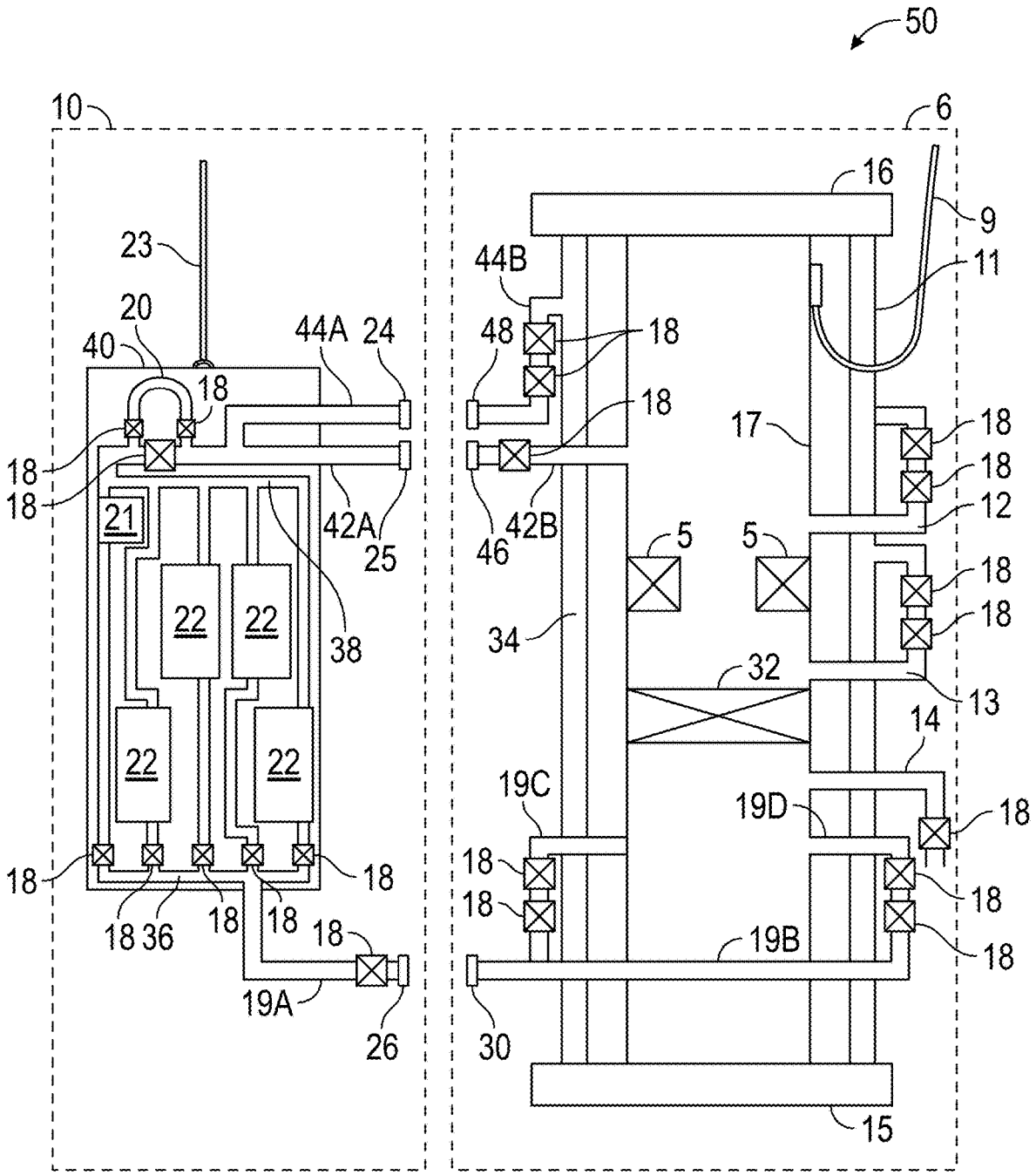
FIG. 2 is a schematic side elevation view, with parts cut away, illustrating a sub-combination embodiment including a modified riser joint and managed pressure sub-system in accordance with the present disclosure.
Figure 3:
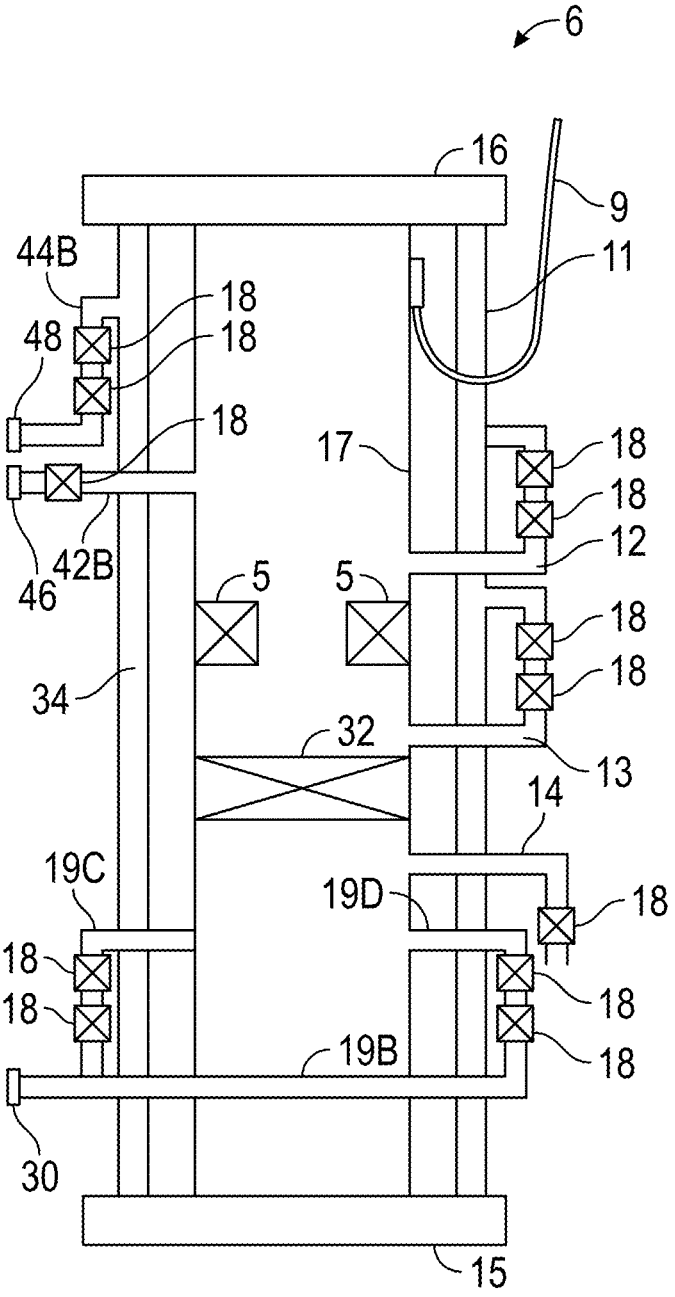
FIG. 3 is a schematic side elevation view, with parts cut away, of the modified riser joint illustrated in FIG. 2.
Figure 4:
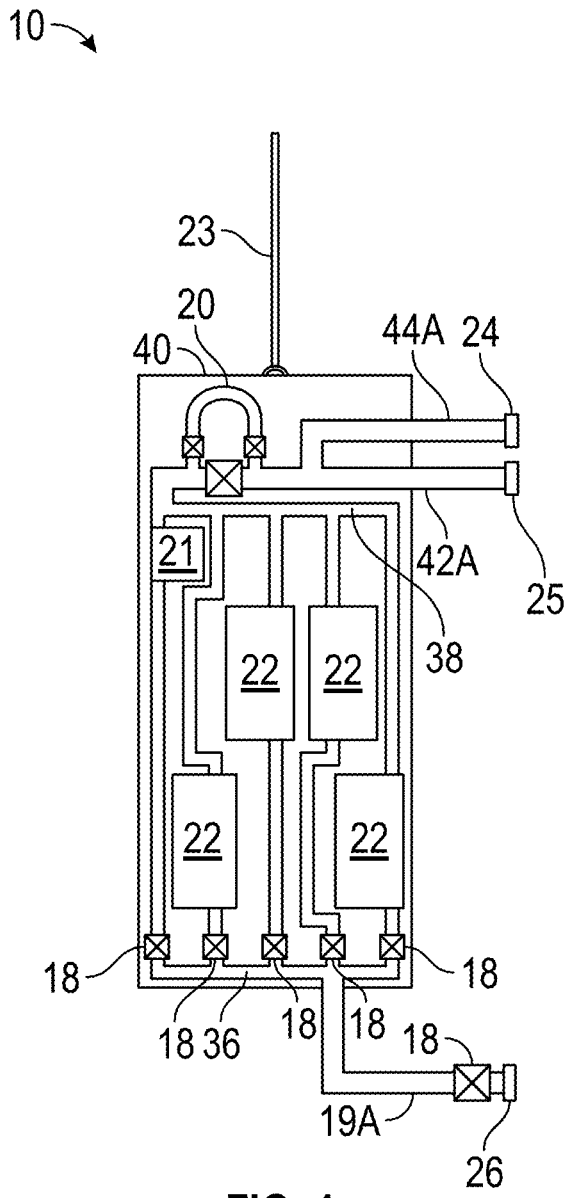
FIG. 4 is a schematic side elevation view, with parts cut away, of the managed pressure sub-system illustrated in FIG. 2

FIG. 2 is a schematic side elevation view, with parts cut away, of one system embodiment 50, while FIGS. 3 and 4 are schematic side elevation views, with parts cut away, of the MRJ and the PMSS illustrated schematically in FIG. 2, respectively. MRJ 6 replaces an existing marine riser joint on the drilling unit, and provides connectivity for all the operational lines existing on the riser. A lowermost portion of MRJ 6 is a riser bottom connection 15, compatible with the drilling unit's existing riser joints 4. Riser bottom connection 15 may be mounted directly a main body 17 of MRJ 6, or as part of a crossover to enable a different bottom MRJ connection to adapt to the existing marine riser 8. Riser bottom connection 15, with or without a crossover, includes one or more conduits for all existing lines or conduits on marine riser 8. These lines or conduits may include: main riser conduit, choke line, kill line, booster line, MUX control line, among others. An uppermost portion of MRJ 6 is also a marine riser connection (top riser connection 16), which provides the same connectivity as bottom riser connection 15.

Referring to the bottom portion of FIGS. 2 and 3, one or more riser flow outlet conduits 19C, 19D, allow directing the drilling mud, drilled cuttings, and other materials returning from the well through wellhead 88, through a flow outlet conduit 19B towards PMSS/MPDM 10 during MPD operations. Flow outlet conduit 19B fluidly connects with fluid inlet conduit 19A on PMSS/MPDM 10. An inlet flow manifold 36 fluidly connects fluid inlet conduit 19A with one or more pressure control devices 22, with assistance of isolation valves 18 and separate inlet flow conduits to each pressure control device 22, and a pressure relief device 21. An outlet flow manifold 38 fluidly connects outlet flows from each pressure control device 22 and pressure relief device 21 as needed. Each of flow outlet conduits 19C, 19D may be configured with one or more independent isolation valve(s) 18. Flow outlet conduit 19B may be fitted with a Remotely Operated Vehicle (ROV) friendly quick connect/quick disconnect (QC/QD) 30 or other means to enable remote releasing of the PMSS/MPDM 10 from MRJ 6 if required. QC/DC 30 connects with a mating QC/QD 26 on PMSS/MPDM 10 (FIG. 4), allowing connection to flow inlet conduit 19A on PMSS/MPDM 10. Isolation valve(s) 18 avoid riser contents to be released to the ocean. The size of outlet conduits 19A-D may be designed to minimize flow restrictions.

Service annular or drill string isolation tool DSIT (32) is a typical component of deep water SBP MPD systems. It is a service device, similar in design and operation to an annular BOP, dedicated to close around drill pipe and provide additional sealing capability and potentially higher pressure rating than a flow control device 5. The most common function of DSIT 32 is to enable changing flow control device 5 sealing element without depressurizing MRJ 6 below DSIT 32. Any known type of service annular and DSIT may be employed in practicing the systems and processes of the present disclosure. Suitable service annulars and DSITs and components typically used therewith include those currently commercially available from Cameron, GE Oil & Gas, NOV, and other suppliers.

Flow control device 5 is a key component of SBP MPD systems and processes. One or more flow control devices 5 enables sealing and pressure containment between the drill pipe (not illustrated) and body of the MRJ or housing for flow control device 5, while allowing the drill pipe to rotate and reciprocate without losing seal integrity. Flow control devices 5 may be rotating flow control devices (RCD) or non-rotating flow control devices (NRCD), or combination thereof (for example, one RCD and one NRCD positioned in series). Several OEMs manufacture and provide flow control devices 5 to the industry. Conceptually, any one or more of the market available flow control devices may be installed as part of MRJ 6. Alternatively, a housing of flow control device 5 may be integral to MRJ 6, minimizing connection points and interfaces. Any known type of flow control device may be employed in practicing the systems and processes of the present disclosure. Suitable flow control devices and components typically used therewith include those currently commercially available from Weatherford International, Schlumberger, and AFGlobal.

A main return conduit 42A on PMSS/MPDM 10 directs the drilling fluid exiting PMSS/MPDM 10 back to MRJ 6 through a matching main return conduit 42B, where main return conduits 42A, 42B may be connected and disconnected through a QC/QD connector (25, 46). Once drilling fluid reaches the internal space defined by main body 17 of MRJ 6, it will continue back to the marine riser joints 4 above MRJ 6 and ultimately to the drilling unit on surface floating vessel 2 or other service vessel for processing and recirculation. Main return conduit 42 may be fitted with ROV-friendly QC/QD connectors (25, 46) or other means to enable remote releasing of PMSS/MPDM 10 from MRJ 6 if required or desired. Isolation valve(s) 18 avoid riser contents to be released to the ocean.

Still referring to FIGS. 3 and 4, in certain system and process embodiments, the well returns may be directed through a choke line returns conduit 44A from downstream of PMSS/MPDM 10 to a choke line inlet conduit 44B fluidly connected to a marine riser choke conduit 34, to enable circulation of incidental formation influxes using the drilling unit's existing well control equipment. This connection of PMSS/MPDM 10 to marine riser choke conduit 34 enhances the capabilities of certain systems and processes of the present disclosure to perform Dynamic Influx Management and riser gas handling operations. Adequate, redundant isolation high pressure valves 18 may be installed in conduit 44B, for example at a specific break between the high pressure choke line 34 and the lower pressure rating PMSS/MPDM 10. The connection between conduits 44A, 44B may be equipped with an ROV friendly QC/QD connector (24, 48) or other means to enable remote releasing of PMSS/MPDM 10 from MRJ 6 if required.

An umbilical/control line 9 may provide hydraulic and/or electric power to operate all the components of MRJ 6 from the drilling unit/floating vessel 2, as well as providing means for transmitting data signals to and from floating vessel 2, such as pressures, temperatures and/or position indicators at different locations throughout MRJ 6.

Installation of a pressure relief outlet and valve (14) below the DSIT can allow protecting the riser from over pressurization as a contingency. Redundant or staged pressure relief can be implemented if desired. Unlike currently available SBP MPD systems, the location of the pressure relief directly on the riser enables direct marine riser pressure protection from blocking of any component of the MPD system.

Boosting inlet conduits (12, 13) may be provided, each fluidly connected to main booster conduit 11. Boosting inlet conduits 12, 13 may be provided in certain system and process embodiments to allow controlled upward fluid movement from positions below main return conduit (42 in FIG. 1; 42B in FIGS. 2 and 3) from PMSS/MPDM 10 to MRJ 6, to prevent drilled cuttings and other solids to fall through the stagnant fluid between flow control device(s) 5 and/or DSIT 32 and main return conduit (42 in FIG. 1; 42B in FIGS. 2 and 3) during managed pressure operations, especially MPD operations.

Depending on the type of flow control device(s) 5 or DSIT 32 selected for use with systems and processes of the present disclosure, boosting inlet conduit 13 may be employed to function as a pressure equalization line, and may provide a means for balancing pressures below and above a closed DSIT 32 prior to opening. This may be the case if the sealing element in flow control device 5 is changed while holding wellbore pressure below DSIT 32.

Referring now to FIG. 4, there is illustrated schematically a side elevation view of one embodiment of a PMSS/MPDM 10 in accordance with the present disclosure. Portions of the cabinet or open frame 40 are cut away to illustrate schematically PMSS/MPDM 10 fitted with four operational pressure control devices (chokes) 22, a contingency pressure control device 21 (for example a pressure relief valve and/or burst disc), mass flow meter 20 with isolation valves 18, and previously discussed conduits 42A (connecting to conduit 42B on MRJ 6, FIGS. 2 and 3) and 44A (connecting to choke conduct 34 via connection to conduit 44B on MRJ 6, also in FIGS. 2 and 3). As indicated herein, certain embodiments may be different on the arrangement and number of components, or combination with pumping devices to enable Dual Gradient Drilling (DGD), depending on the system and process embodiment. These options are not illustrated. As noted previously, main flow returns conduit (19 in FIG. 1; 19A-D in FIGS. 2-4) may be used to directed well returns from MRJ 6, upstream of the PMSS/MPDM 10, for flow and/or pressure manipulation, enabling control of the pressure profile in the well as required for managed pressure operations, especially MPD operations. An isolation valve 18 may be installed in returns line 19A to avoid fluids spillage to the ocean if PMSS/MPDM 10 is disconnected from MRJ 6 at any time. The main flow returns may be directed back to MRJ 6 using conduit 42 (FIG. 1), conduits 42A, 42B (FIGS. 2-3) downstream of PMSS/MPDM 10 for continuation of the conventional flow path to the drilling unit/floating vessel 2. In the event of incidental influxes to the well, the well returns may be routed through conduits 44A, 44B to marine riser choke line 34, instead of to the main tube 17 of riser 8, and this may enable the drilling unit to use its existing choke line, choke manifold and mud gas separator to safely process the contaminated fluid and potential hydrocarbons on surface, without modifications to the surface system. During process embodiments such as these, the operational pressure control devices 22 and contingency pressure control devices 21, if available, enable the driller to perform Dynamic Influx Management on MPD mode, as well as riser gas handling operations.

One or more operational pressure control devices (22) may enable accurate control of the pressure profile on the well, by manipulating restriction to the flow returns from the well. As pressure control devices 22 may be prone to plugging or washing out under certain operational conditions, redundancy can provide means to continue operations should this deviation occur, or to maintain pressure control while addressing the causes, if possible. Adequate number and sizing of the pressure control device(s) 22 may enable accurate pressure control for ample ranges of flow rates, by using more than one valve (and/or a larger size valve) for high flow conditions. Pressure control devices 22 may be designed for remote operation from the drilling unit on floating vessel 2, and/or on different modes of MPD pressure control. Some examples are manual pressure control, semi-automated pressure control (i.e., pressure set point control at the valve location), or fully automated downhole pressure control, which typically involves a hydraulic model calculating in real time the required choke pressure set point for the desired downhole conditions.

A dedicated contingency pressure control device (21) may be used to quickly react to sudden increases in pressure, potentially due to one or more operational pressure control devices 22 plugging with drilled cuttings, or other reasons. This contingency pressure control device 21 may be controlled by an automated system to open and regulate a maximum pressure set point providing time to enable additional flow paths to bypass the blocked component, if available, or to stop operations to correct the deviation.

Mass flow meter (20) may enable monitoring the managed pressure operations on the returns side, and may provide early kick and loss detection by comparison of fluid flow and density out of the well against fluid flow and density being pumped into the well.

Umbilical/control line 23 may enable hydraulic and/or electric power to operate all the components of PMSS/MPDM 10 from the drilling unit/floating vessel 2, as well as enabling transmission of measurement signals to surface, such as pressures, temperatures and/or position indicators at different locations throughout PMSS/MPDM 10. The umbilical line may also provide physical load support for the weight of the MPDM during installation, operations and uninstall. The umbilical may provide capability for retrieving the PMSS/MPDM for service, and for running the module back to the required location once finished the service, all without having to disconnect and retrieve the marine riser.

Figure 5:
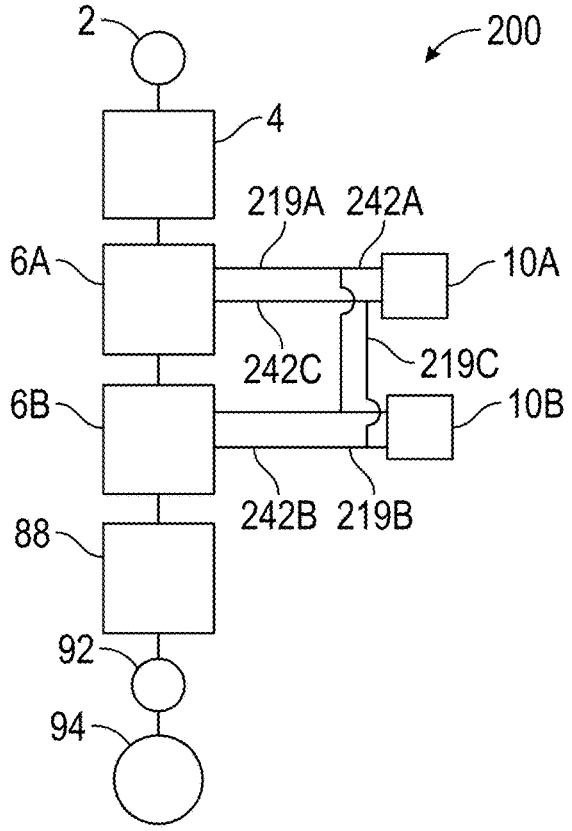
FIGS. 5 and 6 are highly schematic views of two other system and process embodiments in accordance with the present disclosure.
Figure 6:
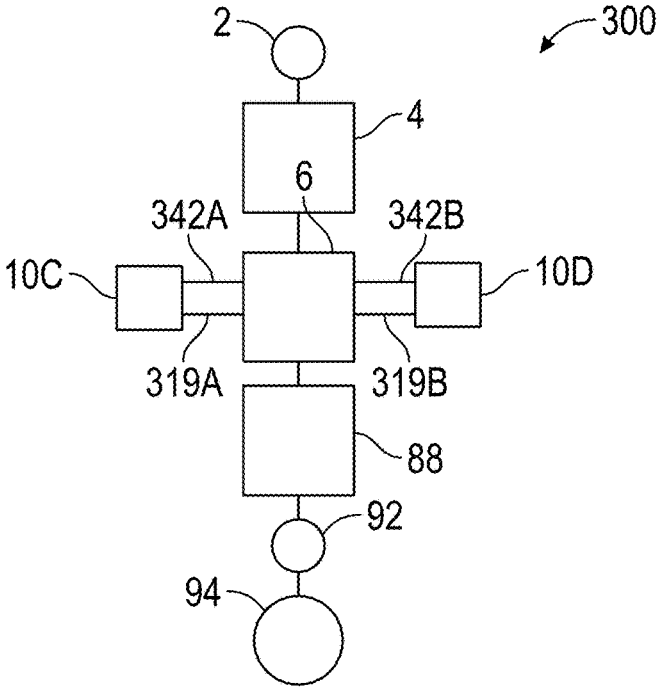

FIGS. 5 and 6 are highly schematic illustrations of alternative system embodiments 200 and 300, respectively, in accordance with the present disclosure. Embodiment 200 includes redundancy in the form of two MRJs (6A, 6B) connected in series, each having a respective PMSS/MPDM (10A, 10B) fluidly connected thereto. In addition, embodiment 200 allows PMSS/MPDM 10A to be used with MRJ 6B, and allows PMSS/MPDM 10B to be used with MRJ 6A, through use of suitable isolation valves (not illustrated). Conduits 219A and 219B function as conduits 19A-D in FIGS. 2-4, while conduits 242A and 242B function as conduits 42A, 42B in FIGS. 2-4. Conduits 219C and 242C allows the redundancy mentioned.

Embodiment 300 includes redundancy in the form of two PMSS/MPDMs (10C, 10D) serving a single MRJ 6. Conduits 342A, 342B serves the function of conduits 42A, 42B in FIGS. 2-4, while conduits 319A and 319B serve the function of conduits 19A-D in FIGS. 2-4. Embodiment 300 allows MRJ 6 to operate with PMSS/MPDM 10C or 10D, for example in alternating fashion. Alternatively, PMSS/MPDM 10C and 10D may operate in conjunction with each other, for example one at relatively low to moderate pressures, while the other operates to control moderate to high pressures.

Certain system embodiments may include some support equipment to enable further functionality. This support equipment may be similar to equipment designed for some other uses in the drilling industry, whether for MPD operations or not. For example, certain systems and processes of the present disclosure may include reels (not illustrated) containing umbilical/control lines 9, 23 for MRJ 6 and PMSS/MPDM 10, respectively. These reels may be installed around the moon pool, if space is available, on floating vessel 2. Alternatively, the reels may be installed on the sides of floating vessel 2, which would require underwater operations to transfer the control lines from the side of the vessel to the moon pool for connection. Control umbilical 23 for PMSS/MPDM 10 may be designed for enough tensile capacity, and the reel designed for running capacity, which allows for planning to retrieve and run back PMSS/MPDM 10 at any time during operations for service. Smaller pieces of equipment may be installed, such as hydraulic power supply, and/or electric main and backup power supply for control of the subsea components. For this purpose, commonly available equipment may be used, provided its design allows for the intended use with the systems and processes of the present disclosure.

One benefit of systems and processes of the present disclosure is there is minimal to no modifications required to enable virtually any floating drilling unit to perform managed pressure operations. Once the system is built, there will be minimal time to install on the drilling unit. Since there are no mud system interconnections on surface, the mud processing system remains untouched. Also, there are no required interfaces with the rig's well control system. Currently available SBP MPD systems require installation of three or four large pieces of equipment, such as a buffer manifold, a junk catcher, a MPD choke manifold, metering skid (if not incorporated on the MPD choke manifold), all of which take significant deck space on the drilling unit/floating vessel 2. Often these kits need to be distributed around different places, even different decks, where space is available. Each one of these kits needs to be interconnected, using large size hard pipe to minimize frictional pressure losses. Also, connection of the MPD system to some of the drilling unit's systems is required, such as connection to the standpipe manifold, to the mud returns system, rig's choke system and mud gas separator, in most cases. All this installation requires extensive planning, assessing location, interconnection, pipe routing, modification to existing pipe, deck loads, penetrations, etc. It is not uncommon that the system design undergoes several iterations and modifications as results of risk assessment as part of the planning process.

Once the planning is completed, fabrication and installation starts, which takes significant time. Critical path installation time is carefully minimized, however significant portions of the installation are required to be performed on critical path, resulting in costly rig downtime. After installation is completed, commissioning, approval and certification process require inspection of welds, pressure testing of the equipment and lines, and audits to validate the final installation as per planned. Only then, and after careful review of documentation, the class certification can be issued.

In contrast, the systems and processes of the present disclosure are self-contained in two units, which are run with and attached to the marine riser. The systems may be transported to the drilling unit/floating vessel, installed and run temporarily, without need for modification to the rig's equipment, or interconnections with the surface equipment. This represents significant cost and time savings. No additional MPD class certification for the drilling unit would be needed, if the systems of the present disclosure are certified by competent bodies.

The systems and processes of the present disclosure enable the drilling unit/floating vessel to perform all currently possible MPD operations with SBP systems, such as surface back pressure and PMCD, including early kick and loss detection, dynamic testing of downhole pressure window, dynamic influx management, constant bottom hole drilling, among others. With the potential enhancement of the systems of the present disclosure, for example with subsea pumping device(s) included in the PMSS/MPDM 10, a variety of Dual Gradient Drilling operations would also be possible, in addition to SBP MPD. Currently, there is no system available in the industry that could perform SBP and DGD operations with the same equipment.

Current SBP MPD systems provide one or more levels of protection for system overpressure. On floating drilling units, the emergency pressure relief is typically installed on the buffer or distribution manifold, which is the first surface MPD component on the returns flow path. It has been highlighted during risk assessment that this location of the emergency PRV does not protect the RCD or the riser from overpressure as results of the event of plugging the MPD hoses, which convey the MPD returns from the MPD riser joint to the connection point on the buffer or distribution manifold. The emergency pressure relief is typically routed overboard, as required by Det Norske Veritas for MPD class certification.

In contrast, the systems and processes of the present disclosure allow implementing direct protection for over pressurization of the riser, discharging to the ocean on event of activation of emergency PRV. In certain embodiments, a contingency pressure control/pressure relief device may be incorporated, with discharge to the riser, to provide primary pressure relief before the emergency PRV system is activated and discharges overboard.

Other systems and processes of the present disclosure may include subsea pumps (as one or more of the pressure control devices 22) in the PMSS/MPDM 10, enabling the system to perform Dual Gradient Operations, without compromising the SBP and PMCD capabilities.

Any known type of non-modified riser joints may be employed in practicing the systems and processes of the present disclosure. Suitable non-modified riser joints and components typically used therewith include the marine risers described in U.S. Pat. Nos. 4,234,047; 4,646,840; 4,762,180; 6,082,391; and 6,321,844; and marine free-standing risers discussed in U.S. Pat. Nos. 7,434,624; 8,960,302 and 9,297,214, as well as published. U.S. patent applications 20070044972 and 20080223583. See also Hatton, et al., "Recent Developments in Free Standing Riser Technology", 3rd Workshop on Subsea Pipelines, Dec. 3-4, 2002, Rio de Janeiro, Brazil. Concentric offset risers are discussed in Szucs et al., "*Heavy Oil Gas Lift Using the COR*", Soc. of Petroleum Engrs. (SPE) 97749 (2005). American Petroleum Institute (API) Recommended Practice 2RD, (API-RP-2RD), First Edition, June 1998), "*Design of Risers for Floating Production Systems (FPSs) and Tension-Leg Platforms (TLPs)*" is a standard in the subsea oil and gas production industry. Concentric risers are discussed in *Subsea Engineering Handbook*, page 437, (published December 2010).

Any known type of QC/QD connector may be employed in practicing the systems and processes of the present disclosure. Suitable QC/QD connectors include those discussed in U.S. Pat. No. 5,645,106 and are currently commercially available from Maxbar Incorporated, Houston Texas (U.S.A.) under the trade designation 84 SERIES. Any known type of umbilical may be employed in practicing the systems and processes of the present disclosure. Suitable umbilicals include those currently commercially available from Aker, Parker, and other. Any known type of mass flow meter may be employed in practicing the systems and processes of the present disclosure. Suitable mass flow meters and components typically used therewith include the coriolis flow and density meters currently commercially available from Emerson (under the trade designation ELITE Peak Performance Coriolis Flow and Density Meter) and other suppliers. Any known type of pressure relief component (PRV, burst disc, or other) may be employed in practicing the systems and processes of the present disclosure. Suitable pressure relief components include those currently commercially available from Expro, London (U.K.) under the trade designation PRV MAX. Any known type of pressure control device may be employed in practicing the systems and processes of the present disclosure, including systems known under the trade designation POWER-CHOKES, commercially available form Expro, London, (U.K.). Suitable chokes include those available from Expro, London (U.K.) under the trade designation POWER-CHOKES. Any known type of mud pumping device may be employed in practicing the systems and processes of the present disclosure. Suitable pumps include those available from Enhanced Drilling, Straume, Norway. Suitable choke and booster line conduits and components typically used therewith include those currently commercially available from riser manufacturers such as Aker, NOV, and others.

During a managed pressure operation, one or all of T, P, mass flow rate, gas or vapor concentrations (or percentages of set point values) inside and/or outside the pressure management sub-system(s) may be displayed locally on Human Machine Interface (HMI), such as a laptop computer having display screen having a graphical user interface (GUI), or handheld device, or similar inside or outside (or both) of pressure management sub-system 10. In certain embodiments the HMI may record and/or transmit the data via wired or wireless communication to another HMI, such as a laptop, desktop, or hand-held computer or display. These communication links may be wired or wireless.

The MRJ and PMSS/MPDM may be made of metals, except where rubber or other polymeric sealing is employed. Suitable metals include stainless steels, for example, but not limited to, 306, 316, as well as titanium alloys, aluminum alloys, and the like. High-strength materials like C-110 and C-125 metallurgies that are NACE qualified may be employed. (As used herein, "NACE" refers to the corrosion prevention organization formerly known as the National Association of Corrosion Engineers, now operating under the name NACE International, Houston, Texas) Use of high strength steel and other high strength materials may significantly reduce the wall thickness required, reducing weight. Threaded connections may eliminate the need for $3^{rd}$ party forgings and expensive welding processes—considerably improving system delivery time and overall cost. It will be understood, however, that the use of $3^{rd}$ party forgings and welding is not ruled out for system components described herein, and may actually be preferable in certain situations.

Certain components made comprise MONEL, HASTELLOY, titanium, alloy 20, aluminum, or other corrosion-resistant machinable metal. Corrosion-resistant alloys may be preferred in certain sour gas or other service where $H_2S$ or acid gases or vapors may be expected, such as T304 stainless steel (or analogs thereof, such as UNS S30400; AMS 5501, 5513, 5560, 5565; ASME SA182, SA194 (8), SA213, SA240; ASTM A167, A182, A193, A194) or T316 stainless steel (or analogs thereof, such as UNS S31600, SS316, 316SS, AISI 316, DIN 1.4401, DIN 1.4408, DIN X5CrNiMo17122, TGL 39672 X5CrNiMo1911, TGL 7143X5CrNiMo1811, ISO 2604-1 F62, ISO 2604-2 TS60, ISO 2604-2 TS61, ISO 2604-4 P60, ISO 2604-4 P61, ISO 4954 X5CrNiMo17122E, ISO 683/13 20, ISO 683/13 20a, ISO 6931 X5CrNiMo17122, JIS SUS 316 stainless steel, or the alloy known under the trade designation MONEL® nickel-copper alloy 400. The composition and some physical properties of MONEL® nickel-copper alloy 400 are summarized in Tables 1 and 2 (from Publication Number SMC-053 Copyright © Special Metals Corporation, 2005). The composition and some physical properties of T304 and T316 stainless steels are summarized in Tables 3 and 4. MONEL® nickel-copper alloy 400 equivalent to UNS N04400/W.Nr. 2.4360 and 2.4361) is a solid-solution alloy that can be hardened only by cold working. It has high strength and toughness over a wide temperature range and excellent resistance to many corrosive environments. The skilled artisan, having knowledge of the particular application, pressures, temperatures, and available materials, will be able design the most cost effective, safe, and operable system components for each particular application without undue experimentation.

TABLE 1

Chemical Composition, wt. %, of MONEL ® Alloy 400

| | |
|---|---|
| Nickel (plus Cobalt) | 63.0 min. |
| Carbon | 0.3 max. |
| Manganese | 2.0 max. |
| Iron | 2 5 max. |
| Sulfur | 0.024 max. |
| Silicon | 0.5 max. |
| Copper | 28.0-34.0 |

TABLE 2

Physical Constants of MONEL ® Alloy 400[a]

| | |
|---|---|
| Density, g/cm$^3$ | 8.80 |
| lb/in.$^3$ | 0.318 |
| Melting range, ° F. | 2370-2460 |
| ° C. | 1300-1350 |
| Modulus of Elasticity, 10$^3$ ksi | |
| Tension | 26.0 |
| Compression | 26.0 |
| Torsion | 9.5 |
| Poisson's Ratio | 0.32 |
| Curie Temperature, ° F. | 70-120 |
| ° C. | 21-49 |

[a]these values also apply to MONEL alloy R-405. the free-machining version of MONEL alloy 400.

TABLE 3

Chemical Composition, wt. %, of T304 and T316 SS

| | T304 | T316 |
|---|---|---|
| Carbon | 0.08 max. | 0.08 |
| Chromium | 18-20 | 18 max. |
| Manganese | 2.0 max. | 2 |
| Molybdenum | 0 | 3 max. |
| Iron | 66.345-74 | 62 |
| Nickel | 8-10.5 | 14 max. |

TABLE 3-continued

| Chemical Composition, wt. %, of T304 and T316 SS | | |
|---|---|---|
| | T304 | T316 |
| Phosphorous | 0.045 max. | 0.045 |
| Sulfur | 0.03 max. | 0.03 |
| Silicon | 1 max. | 1 |

TABLE 4

| Physical Constants of T304 and T316 SS | | |
|---|---|---|
| | T304 | T316 |
| Density, g/cm$^3$ | 8 | 8 |
| lb/in.$^3$ | 0.289 | 0.289 |
| Melting range, ° F. | 2550-2650 | 2500-2550 |
| ° C. | 1400-1455 | 1370-1400 |
| Modulus of Elasticity, 10$^3$ ksi | 28-29 | 28 |
| Poisson's Ratio | 0.29 | |
| CTE, linear 250° C. | 9.89 μin/in-° F. | 9 μin/in-° F. |

One or more control strategies may be employed, as long as the strategy includes measurement of well fluid pressure and those measurements (or values derived from those measurements) are used in controlling the systems and/or processes described herein. A pressure process control scheme may be employed, for example in conjunction with the pressure control devices and mass flow controllers. A master controller may be employed, but the disclosure is not so limited, as any combination of controllers could be used. Programmable logic controllers (PLCs) may be used.

Control strategies may be selected from proportional-integral (PI), proportional-integral-derivative (PID) (including any known or reasonably foreseeable variations of these), and may compute a residual equal to a difference between a measured value and a set point to produce an output to one or more control elements. The controller may compute the residual continuously or non-continuously. Other possible implementations of the disclosure are those wherein the controller comprises more specialized control strategies, such as strategies selected from feed forward, cascade control, internal feedback loops, model predictive control, neural networks, and Kalman filtering techniques.

Figure 7:
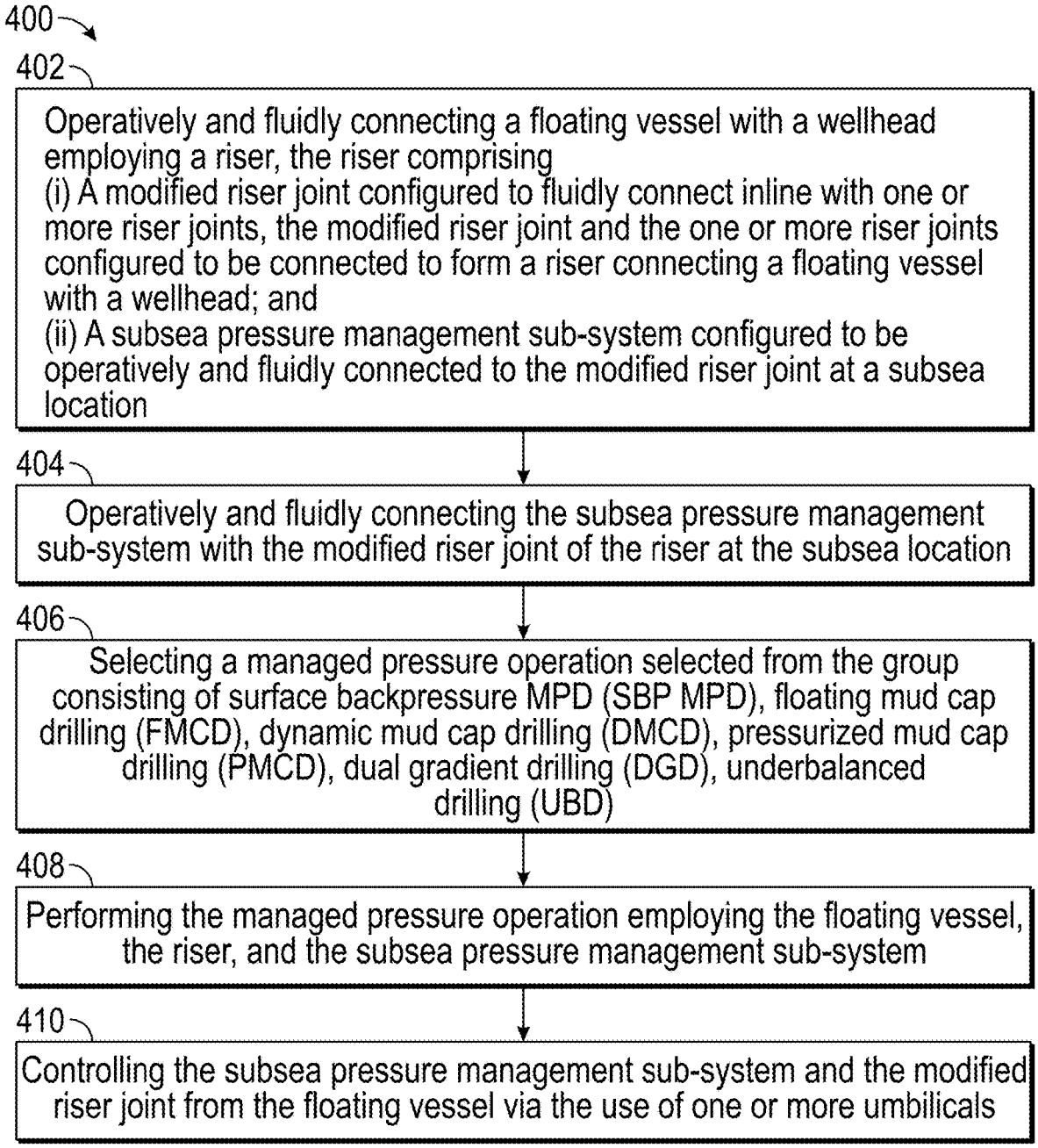
FIGS. 7-9 are schematic logic diagrams of three processes in accordance with the present disclosure.

FIG. 7 is a schematic logic diagram of one process embodiment 400 of a process of the present disclosure. Process embodiment 400 comprises, consists essentially of, or consists of operatively and fluidly connecting a floating vessel with a wellhead employing a riser, the riser comprising (i) a modified riser joint configured to fluidly connect inline with one or more riser joints, the modified riser joint and the one or more riser joints configured to be connected to form a riser connecting a floating vessel with a wellhead; and (ii) a subsea pressure management sub-system configured to be operatively and fluidly connected to the modified riser joint at a subsea location, Box 402. Process embodiment 400 further comprises operatively and fluidly connecting the subsea pressure management sub-system with the modified riser joint of the riser at the subsea location, Box 404; selecting a managed pressure operation selected from the group consisting of surface backpressure MPD (SBP MPD), floating mud cap drilling (FMCD), dynamic mud cap drilling (DMCD), pressurized mud cap drilling (PMCD), Dual Gradient Drilling (DGD), underbalanced drilling (UBD), Box 406; performing the managed pressure operation employing the floating vessel, the riser, and the subsea pressure management sub-system, Box 408; and controlling the subsea pressure management sub-system and the modified riser joint from the floating vessel via the use of one or more umbilicals, Box 410.

Figure 8:
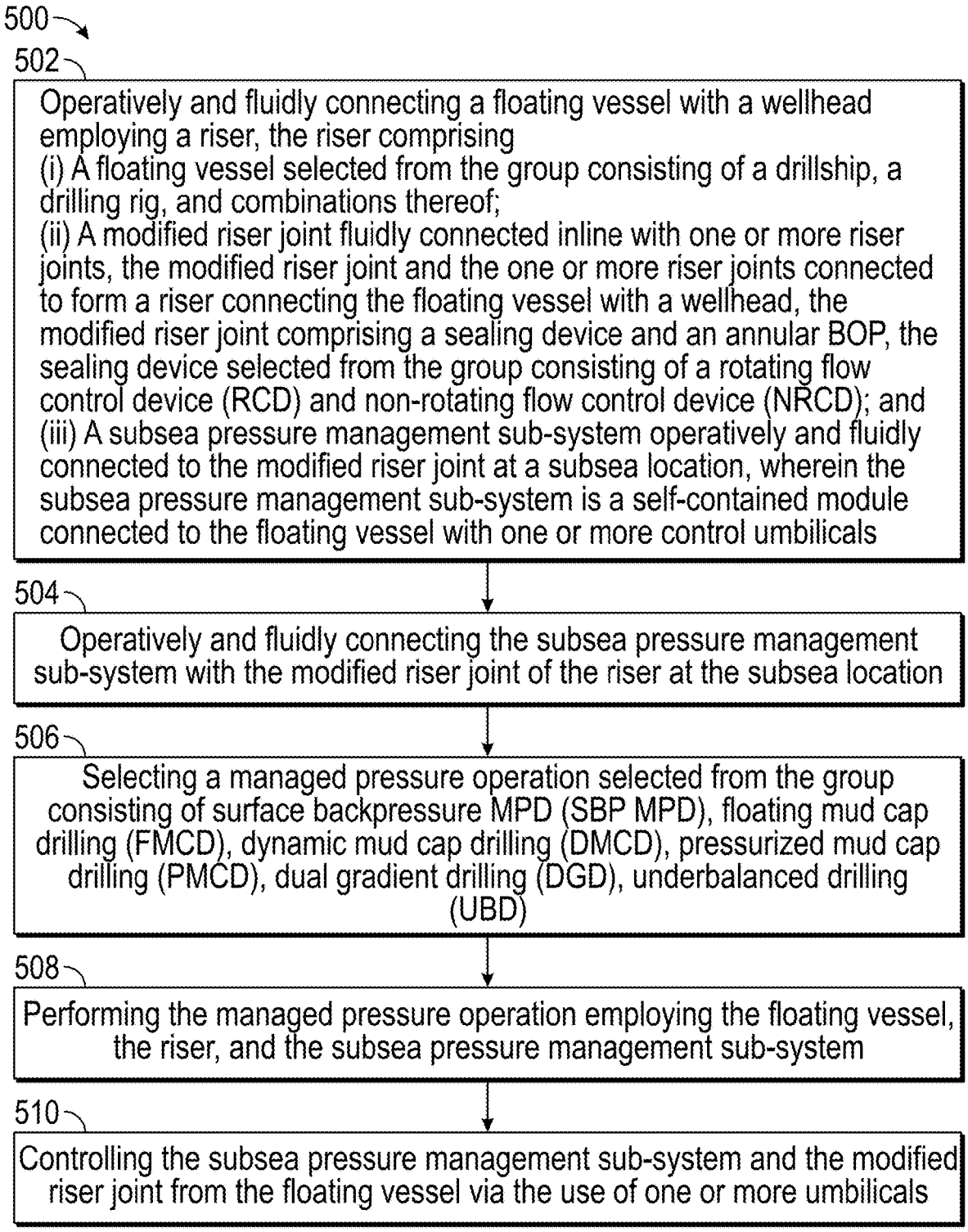

FIG. 8 is a schematic logic diagram of process embodiment 500 of the present disclosure. Process embodiment 500 comprises, consists essentially of, or consists of operatively and fluidly connecting a floating vessel with a wellhead employing a riser, the riser comprising (i) a floating vessel selected from the group consisting of a drillship, a drilling rig, and combinations thereof; (ii) a modified riser joint fluidly connected inline with one or more riser joints, the modified riser joint and the one or more riser joints connected to form a riser connecting the floating vessel with a wellhead, the modified riser joint comprising a sealing device and an annular BOP, the sealing device selected from the group consisting of a rotating flow control device (RCD) and a non-rotating flow control device (NRCD); and (iii) a subsea pressure management sub-system operatively and fluidly connected to the modified riser joint at a subsea location, wherein the subsea pressure management sub-system is a self—contained module connected to the floating vessel with one or more control umbilicals (Box 502). Process embodiment 500 further comprises operatively and fluidly connecting the subsea pressure management sub-system with the modified riser joint of the riser at the subsea location, Box 504; selecting a managed pressure operation selected from the group consisting of surface backpressure MPD (SBP MPD), floating mud cap drilling (FMCD), dynamic mud cap drilling (DMCD), pressurized mud cap drilling (PMCD), Dual Gradient Drilling (DGD), underbalanced drilling (UBD), Box 506; performing the managed pressure operation employing the floating vessel, the riser, and the subsea pressure management sub-system, Box 508; and controlling the subsea pressure management sub-system and the modified riser joint from the floating vessel via the use of one or more umbilicals, Box 510.

Figure 9:
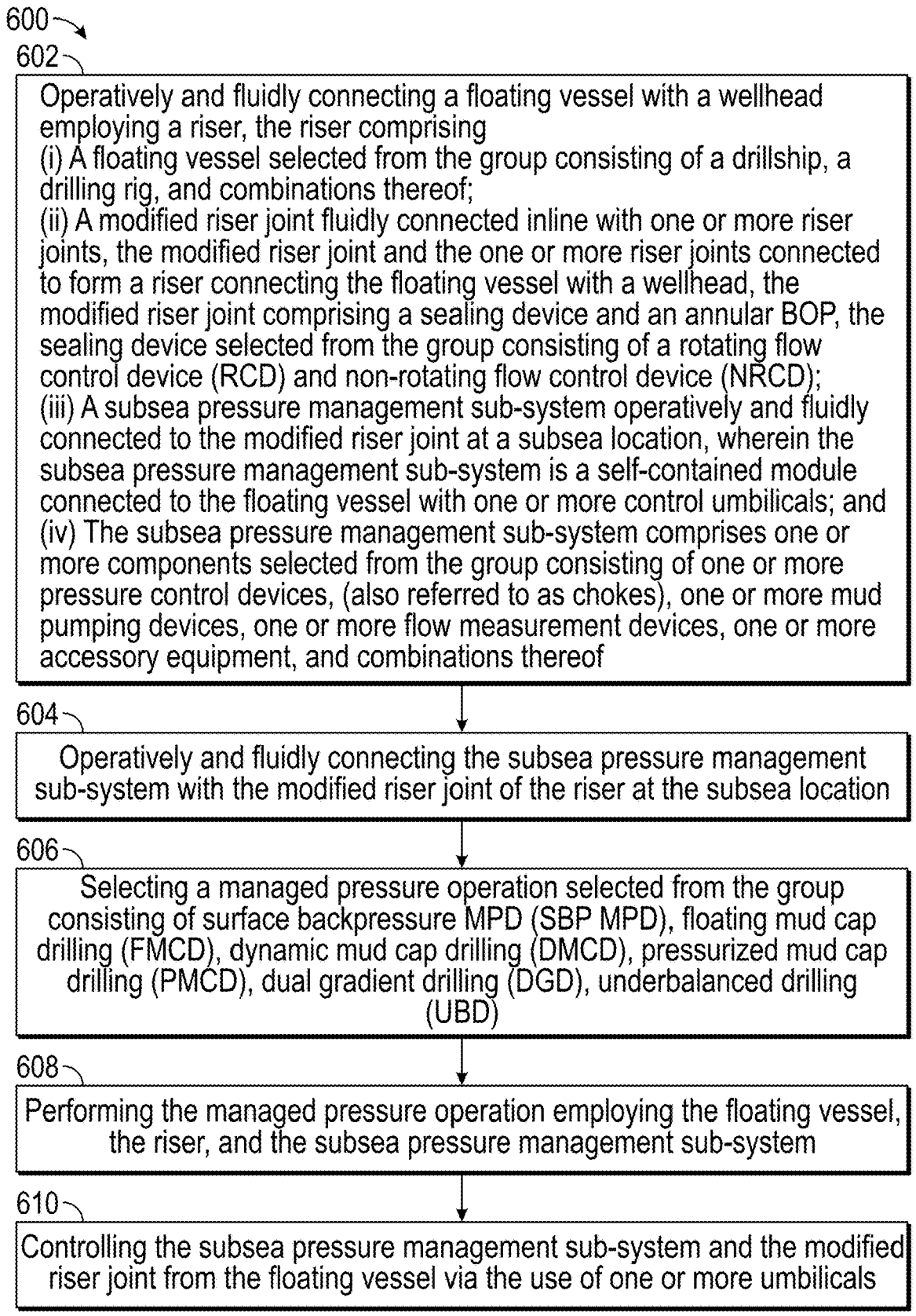

FIG. 9 is a schematic logic diagram of process embodiment 600 of the present disclosure. Process embodiment 600 comprises, consists essentially of, or consists of operatively and fluidly connecting a floating vessel with a wellhead employing a riser, the riser comprising (i) a floating vessel selected from the group consisting of a drillship, a drilling rig, and combinations thereof; (ii) a modified riser joint fluidly connected inline with one or more riser joints, the modified riser joint and the one or more riser joints connected to form a riser connecting the floating vessel with a wellhead, the modified riser joint comprising a sealing device and an annular BOP, the sealing device selected from the group consisting of a rotating flow control device (RCD) and a non-rotating flow control device (NRCD); (iii) a subsea pressure management sub-system operatively and fluidly connected to the modified riser joint at a subsea location, wherein the subsea pressure management sub-system is a self—contained module connected to the floating vessel with one or more control umbilicals and (iv) the subsea pressure management sub-system comprises one or more components selected from the group consisting of one or more pressure control devices, (also referred to as chokes), one or more mud pumping devices, one or more flow measurement devices, one or more accessory equipment, and combinations thereof, Box 602. Process embodiment 600 further comprises operatively and fluidly connecting the subsea pressure management sub-system with the modified riser joint of the riser at the subsea location, Box 604; selecting a managed pressure operation selected from the group consisting of surface backpressure MPD (SBP MPD), floating mud cap drilling (FMCD), dynamic mud cap drilling (DMCD), pressurized mud cap drilling (PMCD), Dual Gradient Drilling (DGD), underbalanced drilling (UBD), Box 606; performing the managed pressure operation employing the floating vessel, the riser, and the subsea pressure management sub-system, Box 608; and controlling the subsea pressure management sub-system and the modified riser joint from the floating vessel via the use of one or more umbilicals, Box 610.

Pressure management sub-systems and modified riser joints may be built to meet ISO standards, Det Norske Veritas (DNV) standards, American Bureau of Standards (ABS) standards, American Petroleum Institute (API) standards, and/or other standards.

The electrical connections, if used (voltage and amperage) will be appropriate for the zone rating desired of the system. In certain embodiments one or more electrical cables may be run and connected to an identified power supply at the work site to operate the HMI, MRJ, and PMSS. Certain embodiments may employ a dedicated power supply. The identified or dedicated power supply may be controlled by one or more logic devices so that it may be shut down. In exemplary embodiments, systems of the present disclosure may have an electrical isolation (lockout) device on a secure cabinet.

In embodiments where connection to one or more remote HMI units is desired, this may be achieved by an intrinsically safe cable and connection so as to allow system components to operate in the required zoned area. If no remote access is required, power to operate the HMI, MRJ, and PMSS may be integral to the apparatus, such as batteries, for example, but not limited to, Li-ion batteries. In these embodiments, the power source may be enclosed allowing it to operate in a zoned area (Zone 0 (gases) in accordance with International Electrotechnical Commission (IEC) processes). By "intrinsically safe" is meant the definition of intrinsic safety used in the relevant IEC apparatus standard IEC 60079-11, defined as a type of protection based on the restriction of electrical energy within apparatus and of interconnecting wiring exposed to a potentially explosive atmosphere to a level below that which can cause ignition by either sparking or heating effects. For more discussion, see "AN9003—A User's Guide to Intrinsic Safety", retrieved from the Internet Jul. 12, 2017, and incorporated herein by reference.

In certain embodiments, internal algorithms in the logic device, such as a PLC, may calculate a rate of increase or decrease in pressure inside the PMSS and/or the MRJ. This may then be displayed or audioed in a series of ways such as "percentage to shutdown" lights or sounds, and the like on one or more GUIs. In certain embodiments, an additional function within a HMI may be to audibly alarm when the calculated pressure rate of increase or decrease reaches a level set by the operator. In certain embodiments this alarm may be sounded inside the pressure management sub-system, outside the pressure management sub-system, as well as remote from the pressure management sub-system, for example in a shipboard control room, or remote control room.

Pressure management sub-systems, cabinets therefore, modified riser joints, logic devices, sensors, valves, and optional safety shutdown units should be capable of withstanding long term exposure to probable liquids and vapors, including hydrocarbons, acids, acid gases, fluids (oil-based and water-based), solvents, brine, anti-freeze compositions, hydrate inhibition chemicals, and the like, typically encountered in offshore and subsea processing facilities.

What has not been recognized or realized are systems and processes for managed pressure operations that are robust and safe. Systems and processes to accomplish this without significant risk to workers is highly desirable. As explained previously, systems and processes exist, but they are not necessarily economical and involve interconnection with existing deck equipment. The present inventors, however, personally know of the inefficiencies of such practices and the inherently unsafe conditions they create.

In alternative embodiments, the pressure management sub-system need not be rectangular, as illustrated in the drawings, but rather the pressure management sub-system could take any shape, such as a box or cube shape, elliptical, triangular, prism-shaped, hemispherical or semi-hemispherical-shaped (dome-shaped), or combination thereof and the like, as long as the pressure sensors, safety shutdown system, logic devices, and the like have suitable fittings to connect (either via wired or wireless communication) to a power source, and/or to one or more ROVs. In yet other embodiments, the pressure management sub-system frame or cabinet may be rectangular, but this arrangement is not strictly necessary in all embodiments. For example, one or more corners of a generally rectangular pressure management sub-system could be rounded, concave or convex, depending on the desired pressure inside the pressure management sub-system. It will be understood that such embodiments are part of this disclosure and deemed with in the claims. Furthermore, one or more of the various components may be ornamented with various ornamentation produced in various ways (for example stamping or engraving, or raised features such as reflectors, reflective tape, patterns of threaded round-head screws or bolts screwed into holes in the pressure management sub-system), such as facility designs, operating company designs, logos, letters, words, nicknames (for example BLADE ENERGY, and the like). The pressure management sub-system may include optional hand-holds, which may be machined or formed to have easy-to-grasp features for fingers, or may have rubber grips shaped and adorned with ornamental features, such as raised knobby gripper patterns.

Thus the systems and processes described herein provide afford ways to perform managed pressure operations safely and economically, and with significantly reduced risk of injury and discomfort to surface vessel and other workers.

Embodiments disclosed herein include:

A: A system comprising:

(a) a modified riser joint configured to fluidly connect inline with one or more riser joints, the modified riser joint and the one or more riser joints configured to be connected to form a riser connecting a floating vessel with a wellhead; and (b) a subsea pressure management sub-system configured to be operatively and fluidly connected to the modified riser joint at a subsea location.

B: A system comprising:

(a) a floating vessel selected from the group consisting of a drillship, a drilling rig, and combinations thereof;

(b) a modified riser joint fluidly connected inline with one or more riser joints, the modified riser joint and the one or more riser joints connected to form a riser connecting the floating vessel with a wellhead, the modified riser joint comprising a sealing device and an annular BOP, the sealing device selected from the group consisting of a rotating flow control device (RCD) and a non-rotating flow control device (NRCD); and (c) a subsea pressure management sub-system operatively and fluidly connected to the modified riser joint at a subsea location, wherein the subsea pressure management sub-system is a self-contained module connected to the floating vessel with one or more control umbilicals.

C: A system comprising:

(a) a floating vessel selected from the group consisting of a drillship, a drilling rig, and combinations thereof;

(b) a modified riser joint fluidly connected inline with one or more riser joints, the modified riser joint and the one or more riser joints connected to form a riser connecting the floating vessel with a wellhead, the modified riser joint comprising a sealing device and an annular BOP, the sealing device selected from the group consisting of a rotating flow control device (RCD) and a non-rotating flow control device (NRCD);

(c) a subsea pressure management sub-system operatively and fluidly connected to the modified riser joint at a subsea location, wherein the subsea pressure management sub-system is a self-contained module connected to the floating vessel with one or more control umbilicals; and (d) the subsea pressure management sub-system comprises one or more components selected from the group consisting of one or more pressure control devices, (also referred to as chokes), one or more mud pumping devices, one or more flow measurement devices, one or more accessory equipment, and combinations thereof.

D: A process comprising:

(a) operatively and fluidly connecting the floating vessel with the wellhead employing the riser of the system of embodiment A;

(b) operatively and fluidly connecting the subsea pressure management sub-system with the modified riser joint of the system of embodiment A at the subsea location; and (c) performing a managed pressure operation employing the floating vessel, the riser, and the subsea pressure management sub-system.

E: A process comprising:

(a) operatively and fluidly connecting the floating vessel with the wellhead employing the riser of the system of embodiment B;

(b) operatively and fluidly connecting the subsea pressure management sub-system with the modified riser joint of the system of embodiment B at the subsea location; and (c) performing a managed pressure operation employing the floating vessel, the riser, and the subsea pressure management sub-system.

F: A process comprising:

(a) operatively and fluidly connecting the floating vessel with the wellhead employing the riser of the system of embodiment C;

(b) operatively and fluidly connecting the subsea pressure management sub-system with the modified riser joint of the system of embodiment C at the subsea location; and (c) performing a managed pressure operation employing the floating vessel, the riser, and the subsea pressure management sub-system.

Each of the embodiments A, B, C, D, E, and F may have one or more of the following additional elements in any combination:

Element 1. Systems and processes wherein the subsea pressure management sub-system is a self-contained module connected to the floating vessel with one or more control umbilicals.

Element 2. Systems and processes wherein the modified riser joint comprises a sealing device and an annular BOP.

Element 3. Systems and processes wherein the sealing device is selected from the group consisting of a rotating flow control device (RCD) and a non-rotating flow control device (NRCD).

Element 4: Systems and processes wherein the floating vessel is selected from the group consisting of a drillship, a drilling rig, and combinations thereof.

Element 5: Systems and processes wherein the subsea modified riser joint is dependent upon a control umbilical connected to the floating vessel.

Element 6: Systems and processes wherein the subsea pressure management sub-system comprises one or more components selected from the group consisting of one or more pressure control devices, (also referred to as chokes), one or more mud pumping devices, one or more flow measurement devices, one or more accessory equipment, and combinations thereof.

Element 7: Systems and processes wherein the one or more accessory equipment are selected from the group consisting of one or more connectors, one or more isolation valves, and one or more pressure relief valves.

Element 8: Systems and processes wherein the annular is configured to have sufficient power and capacity to close the production pipe or tubing upon command by a logic device.

Element 9: Systems and processes wherein the one or more components comprise one or more redundant components in the subsea pressure management sub-system.

Element 10: Systems and processes comprising one or more one or more quick connect/quick disconnect connectors.

Element 11: Systems and processes wherein the MRJ connections are compatible with the specific riser connections existing on the drilling unit, using crossovers for bottom and top connections.

Element 12: Systems and processes wherein the riser connections are integrated on the bottom and top of the MRJ, eliminating the need to fabricate costly crossovers.

Element 13: Systems and processes wherein both electric and hydraulic power supply have redundant and/or back up power supply.

Element 14: Systems and processes wherein the hydraulic power is supplied by an additional hydraulic unit on the drilling rig, optionally including storage for pressurized fluid for backup power.

Element 15: Systems and processes wherein the drilling unit/floating vessel's electric generators provide electric power, and backup power is provided by an uninterruptible power supply (UPS) battery system.

Element 16: Systems and processes wherein the MRJ is stored on the drilling unit/floating vessel riser deck, on a dedicated crate fabricated for this purpose.

Element 17: Systems and processes wherein running the MRJ may be performed with the conventional riser handling equipment, provided the final size and weight are within the handling capability.

Element 18: Systems and processes wherein the MRJ is fabricated with a maximum outside diameter (OD) such that it can be made on the riser on the rotary table, then lowered to the moon pool as a regular (non-modified) marine riser joint.

Element 19: Systems and processes wherein the PMSS/MPDM is located on existing facilities on the drilling unit/floating vessel, such as the Christmas tree trolley (or BOP trolley), and prepared to be run from there. In these embodiments, once the MRJ is at the moon pool position, below the rotary table, the Christmas tree trolley (or BOP trolley) may be used to bring the PMSS/MPDM close to the MRJ and the quick connections made, and wherein umbilical lines for MRJ and PMSS/MPDM are connected during this period.

Element 20: Systems and processes wherein reels are employed to store and handle umbilical lines, with 1) a reel with hydraulic lines for operating all valves and components on the MRJ, and low power electric connections for data transmission for sensors (e.g., pressure, temperature, position indicators, among others); and 2) a reel with electric cable to provide power for operating valves and components on the PMSS/MPDM, as well as low power electric connections for data transmission for sensors (e.g., pressure, temperature, position indicators, flow rates, fluid density, among others).

Element 21. Systems and processes wherein the reel for the PMSS/MPDM umbilical is designed to provide mechanical support for holding some or all the weight of the PMSS/MPDM while being run, and/or during managed pressure operations, and/or when retrieved, the reels installed next to the moon pool if space is available.

Element 22. Systems and processes wherein control signals for the MRJ and PMSS/MPDM, as well as parameters measured or captured by the system's sensors (e.g., pressures, temperatures, fluid flow rates and density, position indicators, etc.) are transmitted to and from the drilling unit/floating vessel from and to the subsea PMSS/MPDM and MRJ.

Element 23. Systems and processes wherein the umbilical control lines provide the means for data transmission.

Element 24. Systems and processes wherein on the drilling unit/floating vessel, the data may be integrated at different levels, potentially with different control systems, similar to data connection and integration with rig's systems currently implemented on various MPD systems, for example, control systems for MPD (installed ad hoc for MPD operations), mud logging, drawworks, top drive, rotary table, pipe handling, and the like.

Element 25. Systems and processes wherein the data integration is accomplished by running cables between different locations on the drilling unit/floating vessel, and in accordance with industry standards, operator requirements, and/or local laws.

Element 26. Systems and processes configured to operate in modes selected from the group consisting of automatic continuous mode, automatic periodic mode, and manual mode.

Element 27. Systems and processes wherein one or more operational equipment are selected from the group consisting of pneumatic, electric, fuel, hydraulic, and combinations thereof.

Element 28. Systems and processes comprising a display with an interactive graphical user interface.

From the foregoing detailed description of specific embodiments, it should be apparent that patentable systems, combinations, and processes have been described. Although specific embodiments of the disclosure have been described herein in some detail, this has been done solely for the purposes of describing various features and aspects of the systems and processes, and is not intended to be limiting with respect to their scope. It is contemplated that various substitutions, alterations, and/or modifications, including but not limited to those implementation variations which may have been suggested herein, may be made to the described embodiments without departing from the scope of the appended claims. For example, one modification would be to take an existing riser joint and modify it to include an RCD or NRCD, an annular, and other components and connections mentioned herein to allow connection to a pressure management sub-system of this disclosure. Some systems of this disclosure may be devoid of certain components and/or features: for example, systems devoid of RCD; systems devoid of low-strength steels; systems devoid of threaded fittings; systems devoid of welded fittings; systems devoid of casing.

What is claimed is:

1. A pressure management sub-system (10) for subsea managed pressure operations, the pressure management sub-system (10) comprising:

a cabinet or open frame (40) having a top and a bottom and containing:

one or more pressure control devices (22), each having an inlet conduit and an outlet conduit;

one or more contingent pressure control devices (21); and one or more mass flow meters (20);

wherein:

each of the one or more pressure control device (22) inlet conduits is fluidly connected with an inlet flow manifold (36), the inlet flow manifold (36) fluidly connected to a fluid inlet conduit (19A) and to the one or more contingent pressure control devices (21), each of the one or more pressure control device (22) outlet conduits is fluidly connected with an outlet flow manifold (38), the outlet flow manifold (38) fluidly connected with a main return conduit (42A) and a choke line return conduit (44A) and to the one or more contingent pressure control devices (21), and the one or more mass flow meters (20) are fluidly connected to the main return conduit (42A).

2. The pressure management sub-system of claim 1 wherein the one or more pressure control devices (22) comprise a plurality of valves, each of which may be independently selected in size and flow rate range, configured to enable accurate pressure control in high flow conditions.

3. The pressure management sub-system of claim 2 wherein the one or more pressure control devices (22) are designed for remote operation from a drilling unit, and/or on different modes of MPD pressure control.

4. The pressure management sub-system of claim 3 wherein the mode of MPD pressure control is selected from manual pressure control, semi-automated pressure control, and fully automated downhole pressure control including a hydraulic model calculating in real time the required choke pressure set point for the desired downhole conditions.

5. The pressure management sub-system of claim 1 further comprising a connection configured to connect the pressure management sub-system (10) to an umbilical/control line (23) to enable hydraulic and/or electric power to operate the one or more pressure control devices (22), the one or more contingent pressure control devices (21), and the one or more mass flow meters (20).

6. The pressure management sub-system of claim 1 wherein each of the inlet flow manifold (36), the fluid inlet conduit (19A), the one or more contingent pressure control devices (21), the outlet flow manifold (38), the main return conduit (42A), the choke line return conduit (44A), the one or more contingent pressure control devices (21), and the one or more mass flow meters (20) each have at least one isolation valve (18).

7. The pressure management sub-system of claim 1 wherein the fluid inlet conduit (19A), the main return conduit (42A), and the choke line return conduit (44A) comprise quick connect/quick disconnect connectors (24, 25, 26).

8. The pressure management sub-system of claim 1 wherein the contingency pressure control device (21) is configured to be controlled by an automated system to open and regulate a maximum pressure set point providing time to enable additional flow paths to bypass a blocked pressure control device (22), if available, or to stop operations.

9. The pressure management sub-system of claim 1 wherein the mass flow meter (20) is configured to monitor the managed pressure operation on the returns side, and provide early kick and loss detection by comparison of fluid flow and density out of a well against fluid flow and density being pumped into the well.

10. The pressure management sub-system of claim 1 further comprising one or more sensors to sense temperature, pressure, gas or vapor concentrations (or percentages of set point values) inside and/or outside the pressure management sub-system.

* * * * *